United States Patent [19]

Supran

[11] 4,432,058

[45] Feb. 14, 1984

[54] MICRO-COMPUTER NETWORK SYSTEMS FOR MAKING AND USING AUTOMATIC LINE-CALL DECISIONS IN TENNIS

[76] Inventor: Lyle D. Supran, 18A Blackheath Rise, London, England

[21] Appl. No.: 169,390

[22] Filed: Jul. 16, 1980

Related U.S. Application Data

[60] Continuation-in-part of Ser. No. 866,492, Jan. 3, 1978, abandoned, which is a continuation-in-part of Ser. No. 460,805, Apr. 15, 1974, Pat. No. 4,071,242, which is a continuation-in-part of Ser. No. 238,888, Mar. 28, 1972, abandoned, Ser. No. 230,897, Mar. 1, 1972, Pat. No. 3,854,719, and Ser. No. 396,067, Sep. 10, 1973, abandoned, which is a division of Ser. No. 230,728, Mar. 1, 1972, abandoned.

[30] Foreign Application Priority Data

Jul. 17, 1979 [GB] United Kingdom ..... 7924918

[51] Int. Cl.[3] ..... G06F 15/44; A63B 61/00

[52] U.S. Cl. ..... 364/410; 273/29 R; 273/31; 340/323 R

[58] Field of Search ..... 364/410, 411; 273/31, 273/29 R, 411; 340/323 R

[56] References Cited

U.S. PATENT DOCUMENTS

| | | | |
|---|---|---|---|
| 3,415,517 | 12/1968 | Krist | 273/31 |
| 3,774,194 | 11/1973 | Jokay et al. | 340/323 R |
| 3,854,719 | 12/1974 | Supran | 273/29 R X |
| 3,982,759 | 9/1976 | Grant | 273/31 |
| 4,004,805 | 1/1977 | Chen et al. | 340/323 R X |
| 4,109,911 | 8/1978 | Van Auken | 273/31 |

FOREIGN PATENT DOCUMENTS

| | | | |
|---|---|---|---|
| 1370332 | 10/1974 | United Kingdom | 273/31 |

*Primary Examiner*—Jerry Smith

[57] ABSTRACT

Systems are disclosed for making automated decisions in tennis based on analyzing effects resulting from the bounce of a tennis ball by means of pattern recognition in order to determine whether the detected "bounce" was a valid bounce of a tennis ball and not caused by other events. The tennis court is laid out with electrical circuits which can define "in" and "out" areas of the court. These circuits are connectable to a network of micro-computers which can analyze the makes and breaks in the electrical circuits resulting from the bounce of an electrically conductive tennis ball and compare said results with predetermined patterns of makes and breaks caused by known valid ball bounces. The systems are designed on a flexible basis to operate with or without an umpire.

The systems use an electrically conductive tennis ball which makes and breaks electrical circuits when bouncing on them. The resulting pattern of makes and breaks is characteristic for an electrically conductive tennis ball in distinction by way of first example from the pattern resulting when a steel tennis racket is touched against electrical circuits deployed around the court and by way of second example from the pattern resulting when an electrically conductive tennis ball rolls along the ground (or remains motionless) in contact with said electrical circuits. The systems may also employ infra-red radiation beams to produce the patterns.

33 Claims, 23 Drawing Figures

32 CHANNEL CABLE SCHEMATIC

MICRO-COMPUTER NETWORK SYSTEMS FOR MAKING AND USING AUTOMATIC LINE-CALL DECISIONS IN TENNIS

RELATED APPLICATIONS

This application is a continuation-in-part of my U.S. application Ser. No. 866,492, filed Jan. 3, 1978, now abandoned, which is a continuation-in-part of application Ser. No. 460,805, filed Apr. 15, 1974, now U.S. Pat. No. 4,071,242, the latter Application being a continuation-in-part of application Ser. No. 238,888, filed Mar. 28, 1972, now abandoned, which claims priority of British application No. 8176/71 filed Mar. 30, 1971, now U.K. Letters Patent No. 1,370,332.

Further the instant Application is a continuation-in-part of my U.S. application Ser. No. 866,492, filed Jan. 3, 1978, now abandoned, which is a continuation-in-part of application Ser. No. 460,805 filed Apr. 15, 1974, now U.S. Pat. No. 4,071,242, the latter Application being a continuation-in-part of my U.S. application Ser. No. 230,897 filed Mar. 1, 1972 now U.S. Pat. No. 3,854,719, which claims priority of British application No. 5865/71 filed Mar. 3, 1971 now U.K. Letters Patent No. 1,370,331.

Further the instant Application is a continuation-in-part of my U.S. application Ser. No. 866,492, filed Jan. 3, 1978, now abandoned, which is a continuation-in-part of application Ser. No. 460,805 filed Apr. 15, 1974, now U.S. Pat. No. 4,071,242, the latter Application being a continuation-in-part of my U.S. application Ser. No. 396,067 filed Sept. 10, 1973, now abandoned, which is a division of my U.S. application Ser. No. 230,728 filed Mar. 1, 1972, now abandoned, which claims priority of British application No. 9313/72, filed Mar. 3, 1971 now U.K. Letters Patent No. 1,370,333 which was divided out of my British application No. 5865/71 filed Mar. 3, 1971 now U.K. Letters Patent No. 1,370,331.

Further the instant Application is co-pending with my U.S. application Ser. No. 313,607 filed Oct. 21, 1981 and now current which is a Streamline continuation-in-part of my U.S. application Ser. No. 866,492 filed Jan. 3, 1978 now abandoned which is a continuation-in-part of my U.S. application Ser. No. 460,805 filed Apr. 15, 1974 now U.S. Pat. No. 4,071,242 which is a continuation-in-part of my U.S. applications Ser. No. 230,897 (filed Mar. 1, 1972 now U.S. Pat. No. 3,854,719) which claims Priority from my British application Ser. No. 5865/71 filed Mar. 3, 1971 now U.K. Letters Patent No. 1,370,331.

FIELD OF THE INVENTION

The present invention relates to micro-computer network systems for making and using automatic line-call decisions in tennis.

DESCRIPTION OF THE PRIOR ART

One basic system comprising an automated monitoring and arbitration system for tennis is disclosed in my British patent specification No. 1,370,332 (U.S. Pat. No. 4,071,242). The automatic monitoring and arbitration system disclosed in this patent specification includes a central processor having a plurality of inputs and outputs; a plurality of electrical conductors arranged on a surface to determine the position of a bounce of a tennis ball; additional electrical detecting devices for automatically detecting the occurrence of certain other specified discrete events in the game of tennis; manually operable means for providing inputs to the central processor; a plurality of indicating devices; means for communicating electrical signals from the conductors and detecting devices to respective inputs of the central processor so as to supply input signals to the latter in the appropriate forms; means for electrically connecting the outputs from the central processor to respective indicator devices; the central processor being programmed to allow it to process the information in accordance with the rules of tennis, whereby the indicator devices can indicate information as required as a result of the processing.

The basic layout of such an automated monitoring and arbitration system is shown in FIG. 3 of the above numbered patent specification, the system employing at least one umpire's visual display unit mounted on the umpire's desk. The umpire's desk also incorporates the central processor and the umpire's monitoring device which includes keys for overriding the decisions made by the central processor and for updating the indicator board.

Constructions and methods of arranging electrical conductors on a tennis court are disclosed in my British Pat. Nos. 1,370,331 (U.S. Pat. No. 3,854,719) and 1,370,333. In one form as disclosed, the electrical detecting means is a surface element in the form of a tape or sheet which is laid on the surface of a court, said surface element containing electrical conductors which can be bridged by a ball striking the surface element. In my British Pat. No. 1,370,333, the surface element may be secured by other means to the surface of a court itself forming an insert in or an integral part of the surface of the completed court, e.g. when it is in the form of a carpet. Also, as disclosed in Pat. No. 1,370,331 (U.S. Pat. No. 3,854,719) the ball contains electrical conductive means formed into the cloth cover of the ball to form an electrically conductive surface to effect the bridging of the conductors of the surface elements of the court.

It will be appreciated that the system disclosed in patent specification No. 1,370,332 (U.S. Pat. No. 4,071,242) requires at least one umpire to operate such a system.

It is an object of the present invention to provide a system which includes means operating on a pattern recognition basis enabling automated differentiation between an action of a tennis ball and other events detected by said system.

It is a further object of the present invention to provide a system which includes means operating on a pattern recognition basis enabling automated differentiation between an action of a tennis ball and other events detected by said system, wherein automated line-call decisions can be indicated without the aid of any linesmen or umpire.

SUMMARY OF THE INVENTION

According to the present invention there is provided a system for making automated decisions in tennis including: electrical circuits which can be switched by means of a tennis ball action in a zone being monitored; and means operating on a pattern recognition basis for recognizing said tennis ball action in distinction from other events.

The system may operate with or without an umpire.

Automated decisions may be indicated, preferably visually and/or audibly. In the latter case they may be indicated by speech, in English, a language other than English or a combination of languages.

Said electrical circuits may be switched on or off, and may include one or more semiconductors.

Said electrical circuits may either be included with or incorporated into a tennis court.

The tennis balls to be used with such a system are preferably electrically conductive.

Said action is preferably the bounce of a tennis ball, and said zone used is preferably for playing tennis.

Preferably said means operating on a pattern recognition basis takes into account one or more of the following:

(a) the duration of switching of said electrical circuits;
(b) the number of said switchings in a given time period;
(c) the number of said electrical circuits switched in a given period of time;
(d) the sequence of said switching;
(e) the combination of said electrical circuits switched.

Said other events may include one or more of the following:

(a) a conductor other than an electrically conductive tennis ball influencing said electrical circuits;
(b) a non-conductor other than said tennis ball influencing said electrical circuits;
(c) events not influencing said electrical circuits;
(d) a steel racket contacting said electrical circuits;
(e) an electrically conductive shoe contacting said electrical circuits;
(f) aerial effects influencing said electrical circuits;
(g) noise influencing said electrical circuits.

In the case where said electrical circuits are included with a tennis court, an electrically conductive tennis ball may switch a plurality of said circuits by bouncing within said zone, whereby said means operating on a pattern recognition basis can distinguish between a bounce of said electrically conductive tennis ball and said other events.

Furthermore, the system may include: a plurality of micro-computers interconnectable to form a network of micro-computers, said circuits being connectable to the micro-computer network system; one or more local and/or remote input/output units connectable to said micro-computers; and means for arranging said micro-computer network system to be capable of operation with or without umpire and linesmen whereby a bounce of said electrically conductive tennis ball on said electrical circuits can be detected by said network of micro-computers and "in"/"out" decisions indicated by one or more of said output units.

Furthermore, in one form, said system may include at least one housing containing: one or more micro-computers; input/output units; switches operable by the players; and connection means to enable connection to electrical circuits included with a tennis court.

Alternatively, in another form, said system may include: an umpire's console; one or more micro-computers; input/output units; and connection means to enable electrical connection to electrical circuits included with a tennis court.

Said umpire's console may include a portable case having a detachable lid; said case being designed to rest on a support carried by the arms of an umpire's chair; and said detachable lid being deployable on other supports of said umpire's chair.

Said electrical circuits may be switched by means of said tennis ball action on a plurality of electromagnetic radiation beams. The electro-magnetic radiation beams are preferably infra-red.

BRIEF DESCRIPTION OF THE DRAWINGS

In FIG. 15A the timescale is about 10 microseconds along the total horizontal axis and low volts are at the top and higher volts at the bottom;

In FIGS. 15B and 15C the timescale is about 10 milliseconds along the total horizontal axis and low volts are at the bottom and higher volts at the top;

In FIGS. 15D, 15E and 15F the timescale is about 20 microseconds along the total horizontal axis and low volts are at the bottom and higher volts are at the top.

DESCRIPTION OF THE PREFERRED EMBODIMENTS

Figure 1:
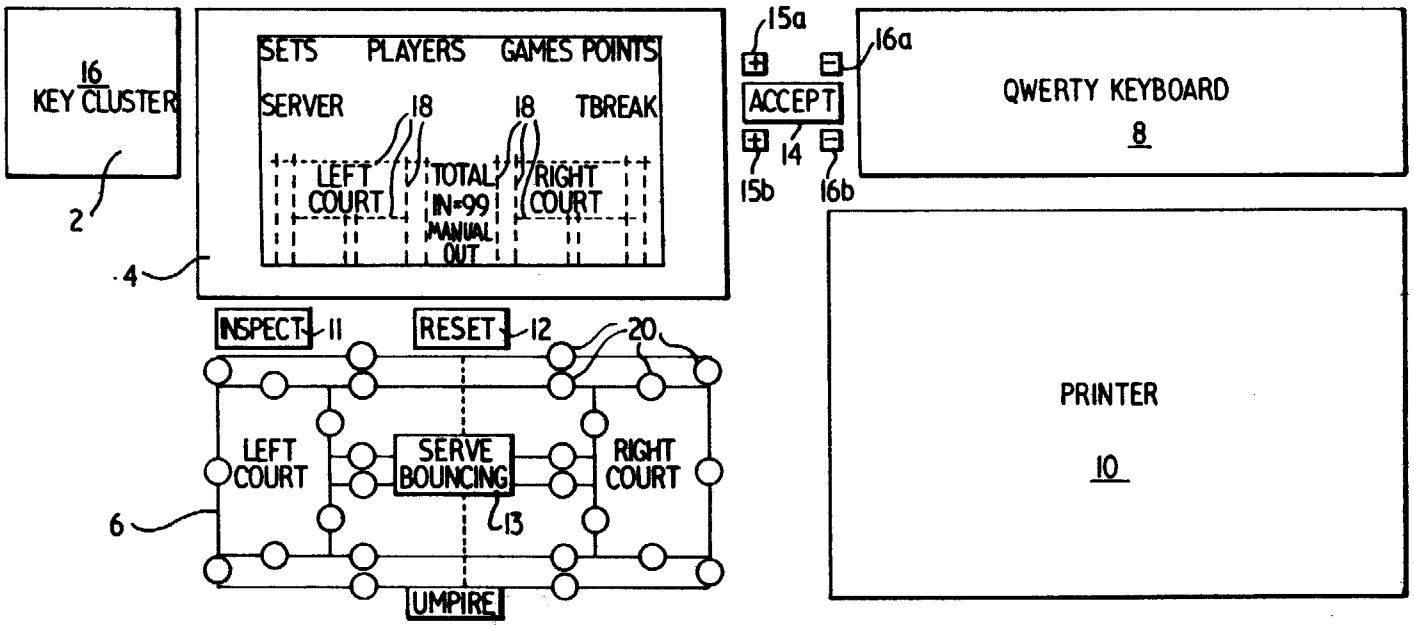
FIG. 1 is a top view of an umpire's console incorporating the basic units which form part of one preferred form of micro-computer network system in which an umpire's console is used.

Referring first to FIG. 1, this illustrates an umpire's console (which includes a first micro-computer which could be way of example only include a Single Board Computer such as iSBC8612 or SYSTEM 80/20-4 which uses processing power from the iSBC80/20-4 all sold by INTEL CORPORATION) which is shown with its lid 100 (see FIGS. 9 and 10) removed and includes the following basic elements protected by waterproofing:

(a) a sixteen key cluster 2;

(b) a first display unit 4 which can have three principal functions, first to display information concerning the players and the state of the score, secondly to display when required a replay of the previous point, and third to display any other relevant information for the benefit of the umpire or engineer (e.g. to check the system);

(c) a second display 6 which can serve two functions, firstly to display when the system has detected a ball "out" of play and secondly to enable non-operation of defined electrical circuits to be indicated;

(d) a sixty-four key keyboard 8 to enable the umpire to input information into the system and to assist him with control functions;

(e) a printer 10;

(f) various umpire control keys 11, 12, 13 and 14 respectively marked "inspect", "reset", "serve bouncing" and "accept", (g) a pair of keys 15A and 15B marked "plus" and a pair of keys 16A and 16B marked "minus".

The first display unit 4 can be a general purpose visual display unit used for the following purposes.

Firstly it can be used to display the status of the match including the score. Secondly, it can be used for the "replay" of the preceding point whereby the left and right courts are indicated on the lower part of the display area by lines 18, particular ones of which are slashed for a selected period of time (such as three seconds) in sequence when the system displays "in" and/or "out" decisions during simulated "replay" of the preceding point. The purpose of the "replay" facility is to display to the umpire the history known to the system of the point concerning which he is about to update the score.

The Second display 6 can include a plurality of discs 20 each one indicating defined electrical circuits on the court. Each disc 20 is rotatable through 180° by electromagnetic or other means so that it either displays its first white face or its second face which is orange. When during the play of a particular point, the system makes a decision that the ball is "out", the particular electrical circuits where the "out" was detected can be indicated by the associated disc being rotated to show orange instead of white. The discs 20 can be normally reset to white when the "accept" key 14 is depressed by the umpire. In addition to the discs 20 indicating the "out" position of a ball on the court, they may also indicate the non-operation of the associated electrical circuits, and any failure of a disc to revert to white following "accept" can indicate that the associated electrical circuits are non-operational. This non-operational feature will be described in greater detail with reference to FIG. 6.

The "accept" key 14 enables the umpire to accept the displayed score. The "plus" keys 15A and 15B permit him to increment the score of either side. The "minus" keys 16A and 16B enable him to decrement the score of either side, for example in the event that a mistake has arisen and a correction is necessary.

The "inspect" key 11 enables the umpire to inspect the latest "accepted" score. The inspected score remains displayed for as long as he keeps the "inspect" key 11 depressed. The "reset" key 12 is operated by the umpire every point as soon as the ball goes out of play and serves to temporarily disable all the circuits on the court so that any further inputs from these circuits will temporarily be ignored.

The "serve bouncing" key 13 is pressed and held down by the umpire immediately before the served ball bounces and is held depressed whilst the served ball is bouncing and is released by the umpire immediately after that bounce has been completed.

Depressing the "serve bouncing" key 13 can "enable" those circuits being served at, i.e. signals resulting from the centre service line and service lines and the service box concerned for the point in question on the appropriate side of the court will not be ignored and can be processed. Releasing the key 13 can "enable" all the circuits which are required for singles or doubles as appropriate and can "disable" those circuits relating to the centre service line and service lines on both sides of the court (i.e. signals resulting from those lines will be ignored).

Figure 2A:
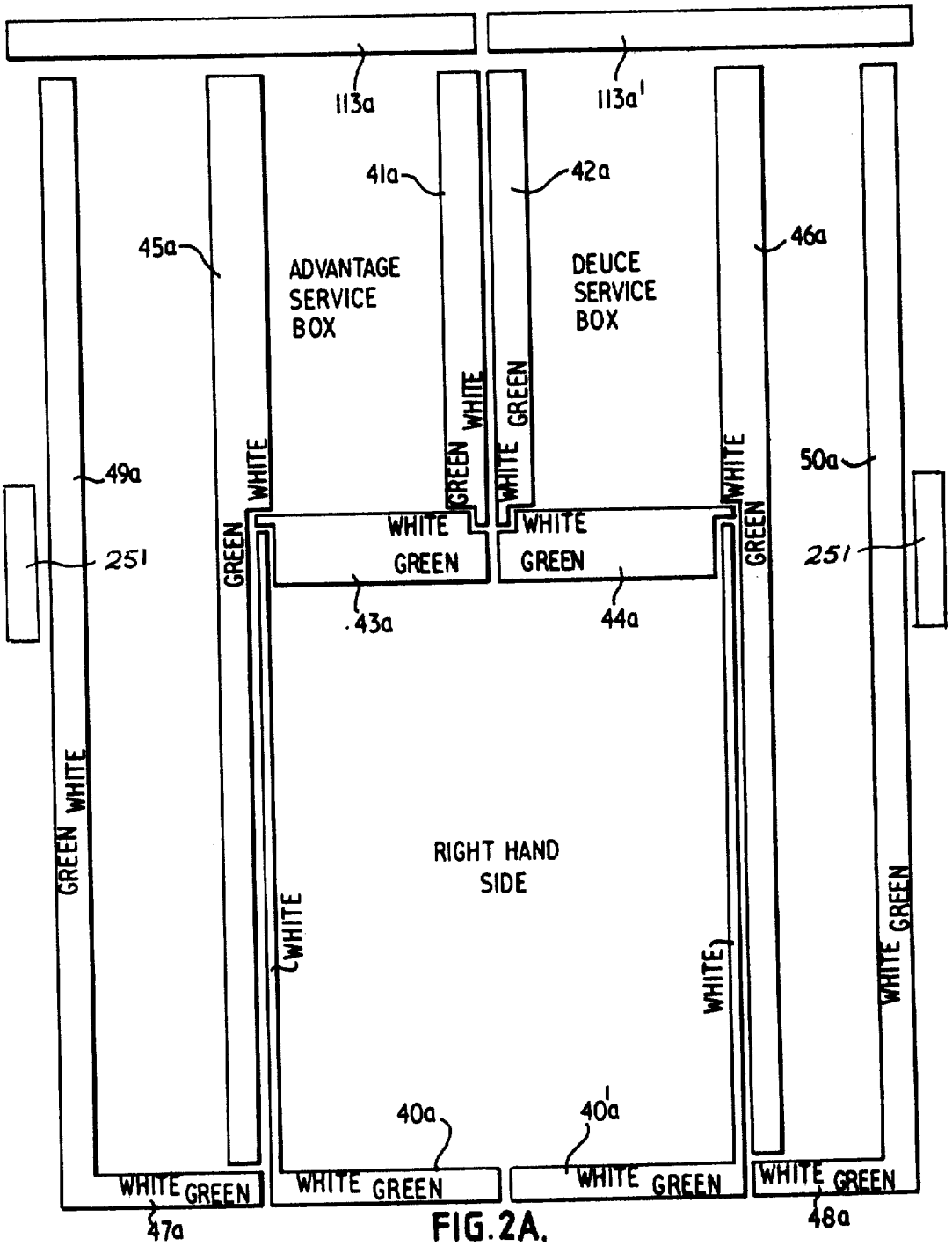
FIGS. 2A and 2B are diagrammatic representations showing the layout of the right-hand side and left-hand side of a tennis court respectively (as viewed by an umpire) incorporating electrical circuits; such a layout of electrical circuits on a tennis court can be used in conjunction with an umpire's console such as that of FIG. 1 or alternatively if no umpire is available then such a layout can be used in conjunction with for example housings H1 and H2 (see FIGS. 11A, 11B and 12)
Figure 2B:
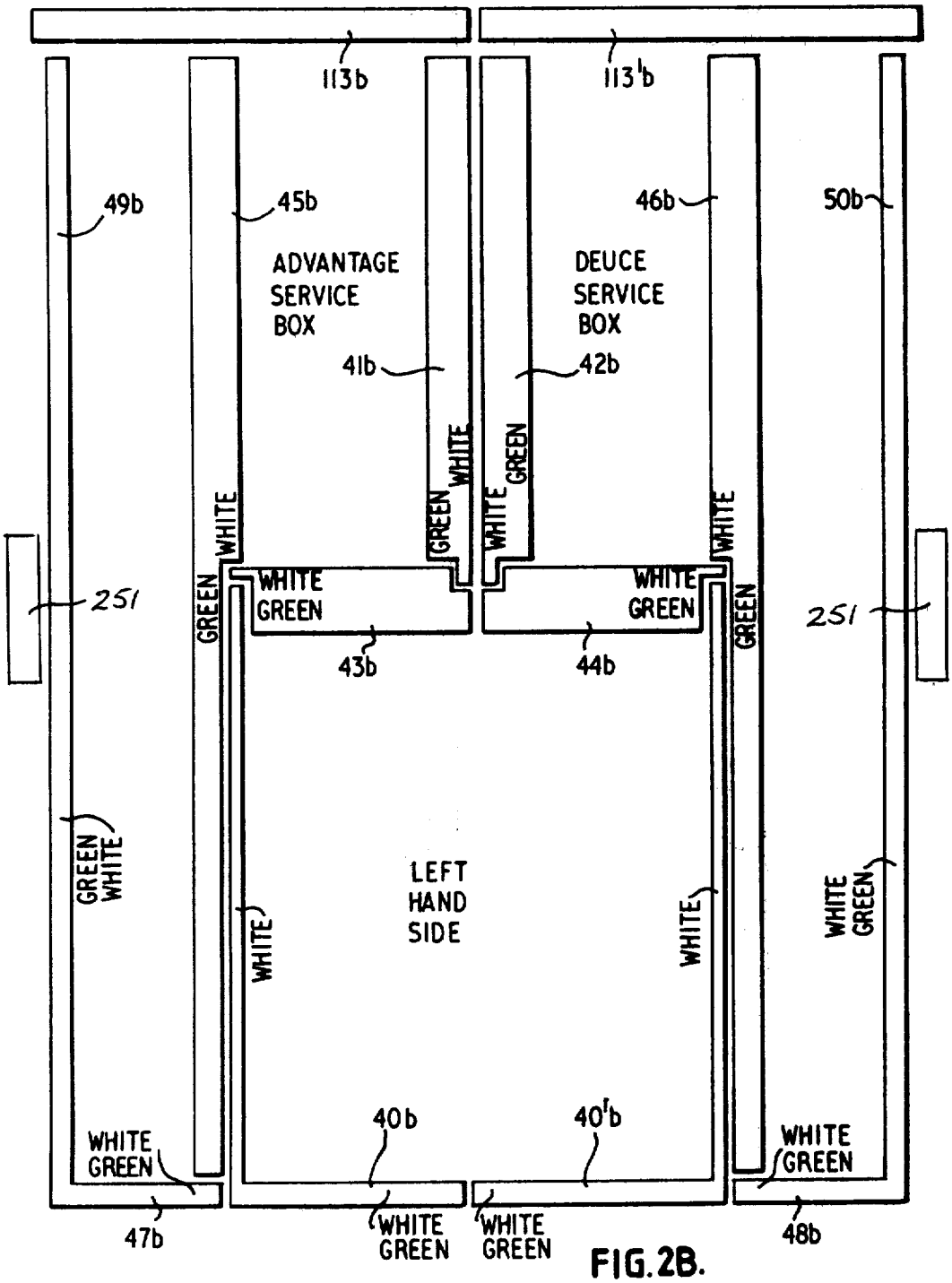

Referring now to FIG. 2, which shows the right-hand side (FIG. 2A) of a tennis court and the corresponding left-hand side (FIG. 2B) relative to an umpire, electrical circuits are incorporated to facilitate decision making by the system and also boxes 251 can be suitably displaced from the sides of the court providing transmitters and/or receivers of electromagnetic radiation beams such as infra-red beams. These transmitters and/or receivers must be suitably aligned with each other and with zones of the court being monitored (e.g. lines 43*a* and 44*a*). The electrical circuits each include a plurality of uninsulated electrical conductors hereinafter referred to as "channels" in relation to FIGS.3, 4, 5 and 6. In FIG. 2A, the base line of the right-hand side as viewed by an umpire is divided into four sections, two central sections 40*a* and 40'*a*, and two side sections 47*a* and 48*a* at the ends thereof and between the "tram-lines". The "tram-lines" can include by way of example all or part of white areas from lines 40*a*, 43*a*, 45*a* and 49*a* down one side of the right-hand court. Similarly down the other side of the right-hand court the other tram lines can include all or part of white areas from lines 40'*a*, 44*a*, 46*a* and 50*a*. Two lines 43*a* and 44*a* circuitize the service line area of the two service boxes of the right-hand court in which appropriate service bounces should take place. Finally circuitized lines 41*a* and 42*a* divide the two service boxes, which are completed by 45*a* and 46*a* white areas.

The left-hand side of the court is shown in FIG. 2B, and the layout is similar to the right-hand side of the court, equivalent lines bearing the suffix b instead of a.

It will further be appreciated that different layouts can be adopted for example to optimize use of the circuits as aerials.

In addition to the above described electrical circuits on the court, electrical circuits and/or pressure sensitive elements can be provided at the net of the tennis court. The purpose of these circuits and/or pressure sensitive elements can be to assist determination as to whether or not a "let" has taken place on service. Pressure sensitive elements can also be incorporated into the tennis court for example by the use of pressure sensitive rubber into carpet backing material.

Circuits and detection elements on the court and net can be connected via one or more BUSSES such as by way of example 113*a* and 113'*a* and appropriate signal conditioning and line termination to one or more microcomputers.

In order to counteract any unwanted "aerial" effects which may arise due to electrical circuits on the court acting as aerials, it is desirable to balance corresponding circuits, for example to compare inputs from corresponding circuits on the right side and the left side of the court and/or to compare inputs from similar circuits on the same side of the net. Using this type of method if similar court circuits acting as aerials give rise to unwanted and balancing signals then these can be ignored.

At a given state of a tennis match, wherein an umpire is officiating with the aid of an umpire's console such as that of FIG. 1 and when the umpire has "accepted" the latest score, the system knows that for example the next service will be intended to bounce in the "deuce" service box of the right-hand side of the court (referring again to FIG. 2A). When the umpire accordingly depresses the "serve bouncing" key 13 appropriate circuits can be "enabled" to detect the bounce of the ball being served. Such circuits for the present example are those used in the lines marked in FIG. 2A as 41*a*, 42*a*, 43*a*, 44*a*, 40'*a* and 46*a*. All other lines can be "disabled" i.e. ignored. When the bounce of the served ball has just been completed the umpire releases the "serve bouncing" key 13 which can cause all circuits to be enabled. The preceding sentence assumes that no "let" decisions are being tested automatically and that no automatic foot-fault detection is employed.

In such a system the umpire can be reminded whether or not the "serve bouncing" key 13 is depressed by means of an audible signal which is suitable for him alone to hear and which occurs whilst the "serve bouncing" key 13 is depressed but stops as soon as the "serve bouncing" key 13 is released. Alternatively an earpiece may provide such an audio signal directly to the ear of the umpire only. Alternatively the "serve bouncing" key 13 can be made to vibrate whilst it is depressed.

Figure 3:
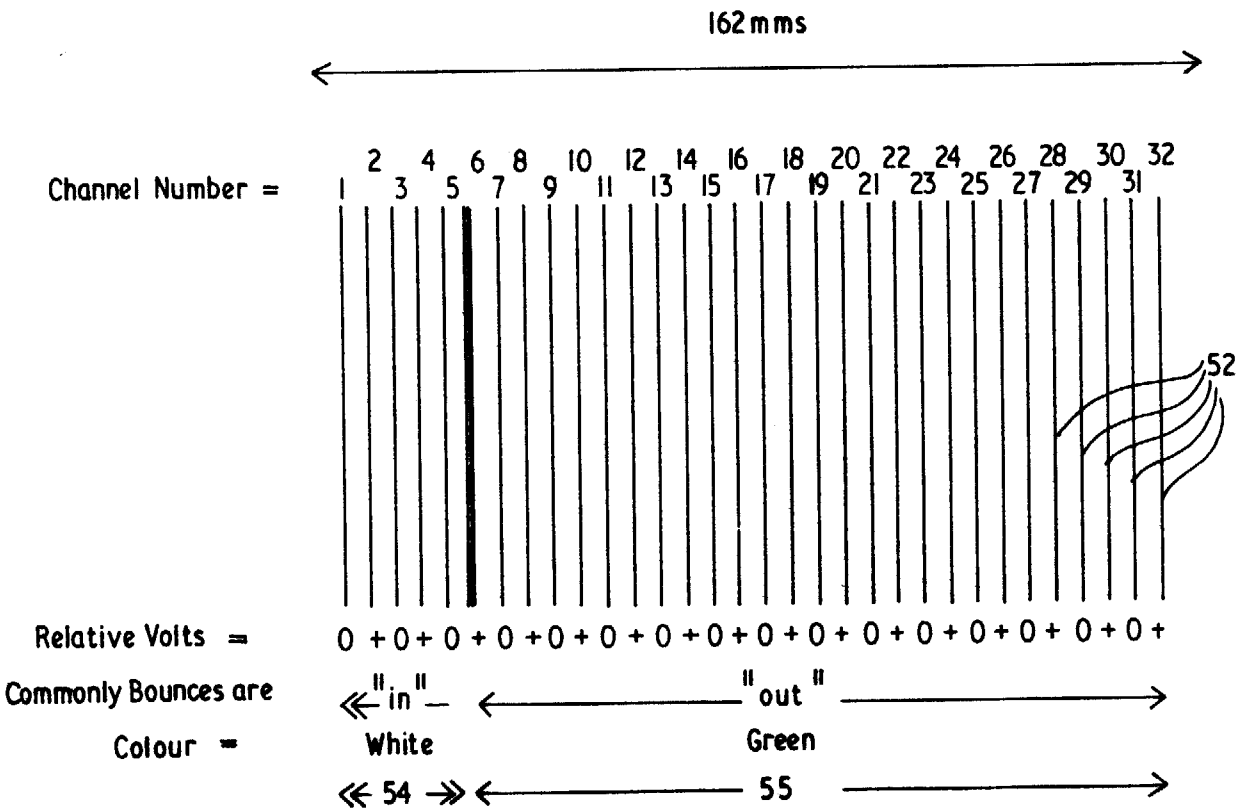
FIG. 3 is a diagram showing the arrangement of thirty-two conductive and uninsulated channels using which the electrical circuits on a given line can be derived.

Referring now to FIG. 3, it will be seen that each line can have thirty-two uninsulated channels 52 (which can be metallic wires) in which the first six channels are located in the commonly (though not always) "in" zone 54 of the line i.e. part of the "white line" and the remaining uninsulated channels are located in the commonly (though not always) "out" zone 55 of the line i.e. a "green area". Uninsulated channels are separated each from the other by means of insulated channels.

Whilst commonly the "white" areas define an "in" zone and the "green" areas an "out" zone, it will be appreciated that the "green" area may be "in" for example in the case of the line 41*a* (FIG. 2A) whenever the service is into the "advantage" service box. In this case the green area of 41*a* represents "in". Likewise the "white" channels may define an "out" zone, for example in the case of lines 47*a*, 47*b*, 48*a* (FIGS. 2A, 2B) when a "singles" match is being played. In this case the white areas represent "out".

It will be appreciated that by way of example the service line in the right-hand side court is "white" and is represented by the white areas of 43*a* and 44*a* as well as by the extreme ends of 41*a* and 42*a* as shown in FIG. 2A. Channels can be rendered electrically conductive by the use of organic conductive materials instead of or as well as metallic conductive materials.

Instead of using a tennis court laid out with the conventional white lines a multi-coloured surface can be used having different colours to indicate different areas of the court, but without white lines. Such arrangements affect the colours of insulation materials used for court circuits.

Figure 4:
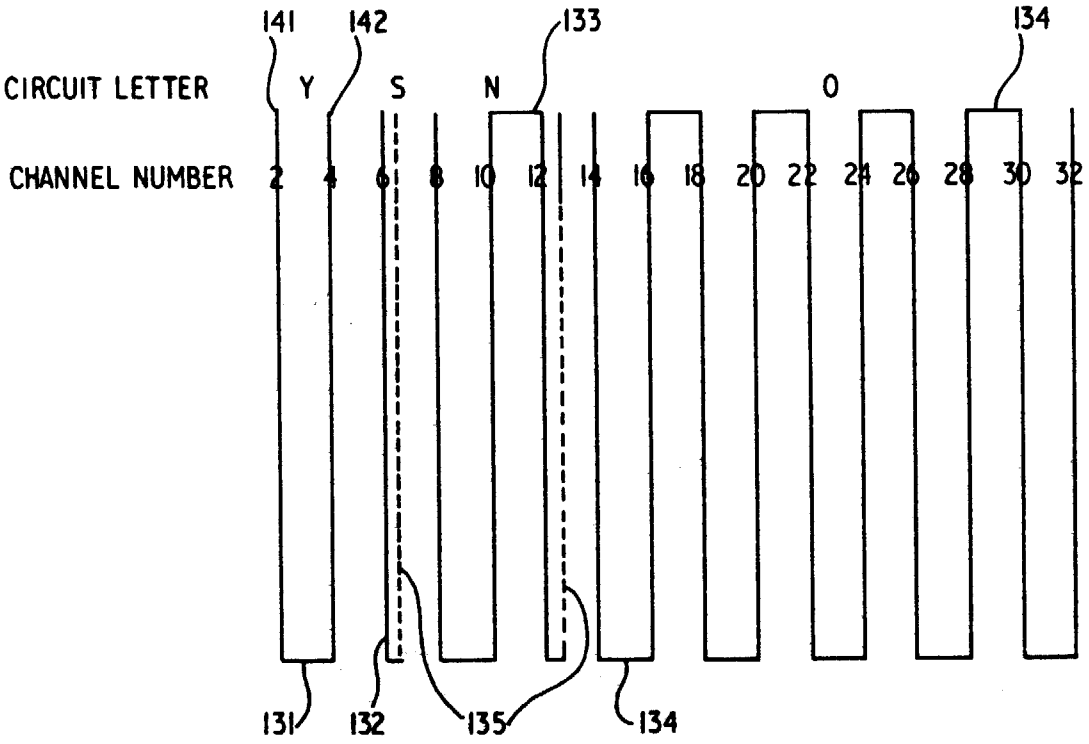
FIG. 4 is a diagram showing how various even numbered conductive and uninsulated channels can be interconnected to form electrical circuits, where appropriate introducing insulated return channels.
Figure 5:
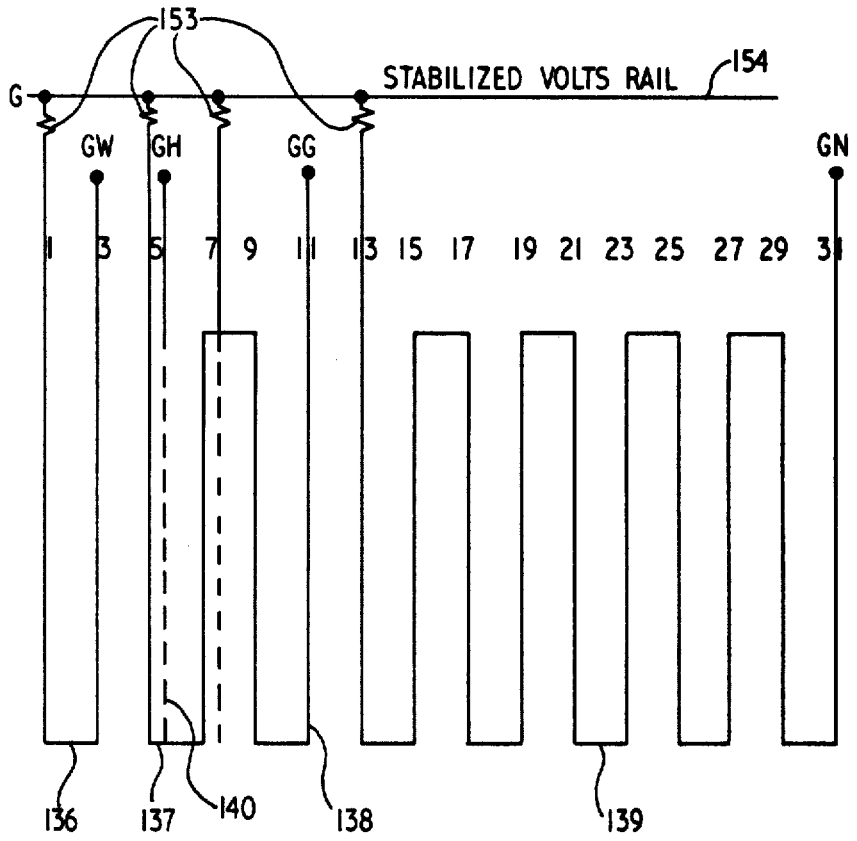
FIG. 5 is a diagram showing how odd numbered conductive and uninsulated channels can be interconnected to form electrical circuits, where appropriate introducing insulated return channels.

Referring now to FIGS. 4 and 5, the 32 uninsulated or naked wire channels in conjunction with insulated wire channels on a given line can be connected so as to provide "circuits" which can be completed by an electrically conductive tennis ball bouncing on the white and/or green areas of that line. Eight such "circuits" can by way of example be established by means of suitable electrical connections. This is illustrated by FIGS. 4 and 5 where "circuits" labelled Y, S, N, O and G/GW, G/GH, G/GG, G/GN respectively are indicated. The "circuits" Y, S, N, O can each be connected to a first electrical potential for example +5 volts. The open ends of a given "circuit" for example the ends 141 and 142 of "circuit" Y can be independently connected to some first voltage level such as +5 volts. The "circuits" G/GW, G/GH, G/GG, G/GN can each be connected via suitable impedances 153 to a second electrical potential (for example zero volts) represented by the stabilized volts rails 154 labelled G. It can be arranged that such connections can be switched electronically or by other means, so that Y, S, N, O "circuits" are each connected to zero volts and G/GW, G/GH, G/GG, G/GN "circuits" are each connected to +5 volts. For convenience this switching can be referred to as LEVELS SWITCHING and can be performed by an electronics module which can be referred to as a LEVELS MODULE. This LEVELS MODULE will be referred to subsequently in relation to FIG. 13.

Referring now to FIG. 4 "circuit" Y (131) can be established by connection as indicated of channels 2 and 4. "Circuit" (132) can be established by connection of channel 6, which is a naked wire, to one of the insulated wires physically separating channels 6 and 8. Such a connection can be referred to as providing an insulated return path (135) and is shown by a dotted line in FIG. 4. "Circuit" N (133) can be established by connecting channels 8, 10 and 12 and by providing an insulated return path. "Circuit" O (134) can be established by connecting channels 14, 16, 18, 20, 22, 24, 26, 28, 30 and 32 as indicated in FIG. 4.

Referring now to FIG. 5 the "circuit" G/GW (136) can be established by connecting channels 1 and 3. "Circuit" G/GH (137) can be established by connecting channel 5 to an insulated return path (140). "Circuit" G/GG (138) can be established by connecting channels 7, 9, 11 and an insulated return path. "Circuit" G/GN (139) can be established by connecting channels 13, 15, 17, 19, 21, 23, 25, 27, 29 and 31. Each of these circuits is connected via appropriate impedances 153 to a stabilized volts rail 154 labelled G. The stabilized volts rail 154 can be switched from a first volts level (say +5 V) to a second volts level (say zero volts) and back again. Such switching can be electronically or manually effected by using the LEVELS MODULE (referred to in relation to FIG. 13).

Figure 6:
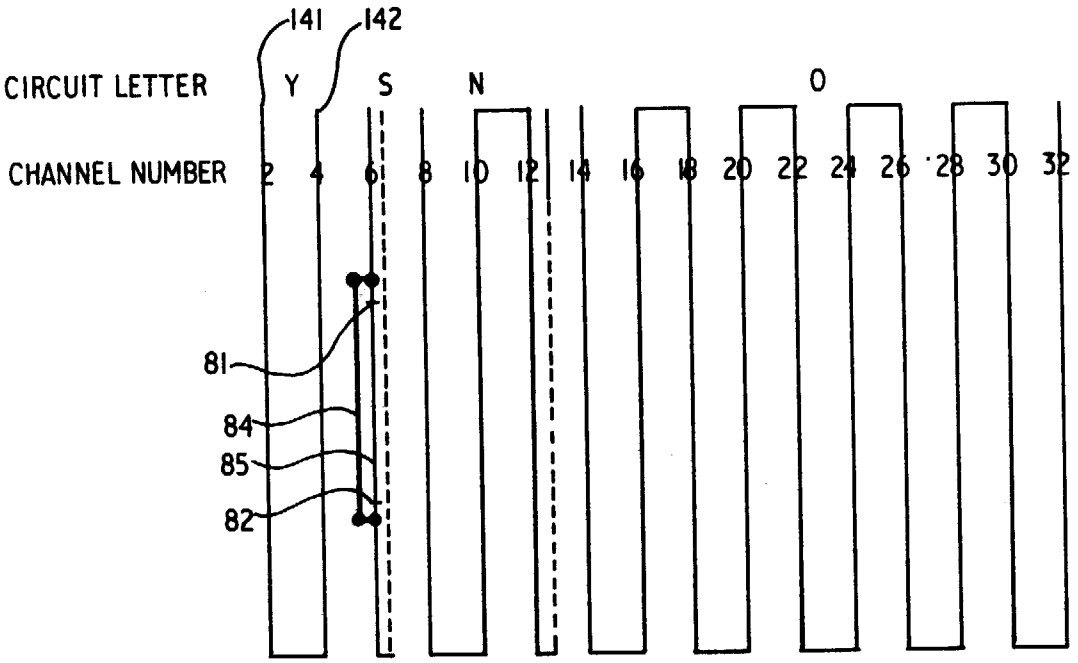
FIG. 6 is a diagram indicating how a channel can be repaired in the event that it becomes open-circuited.

Referring now to FIG. 6, in order to effect a repair to the channels in the event of an open-circuit occurring, each line carries spare insulated channels additional to those insulated channels used as return paths and additional to channels Nos. 1 to 32. Thus, a repair can be effected, once the position of the open circuit has been detected, by appropriate bridging across onto the adjacent spare channel on either side of the open circuit. If a spare insulated channel is used to effect a repair or to provide an alternative conductive path it can if appropriate be stripped of insulation. The repair path or alternative conductive path can if required be electrically disconnected from the remainder of the spare channel.

FIG. 6 shows how a "circuit" (e.g. "circuit" S, channel 6) which has become open-circuited in two places 81 and 82 could be repaired by electrically connecting a length 84 of an adjacent spare return path. Alternatively each break 81 and 82 could be individually repaired in a similar way. The spare return path when used for repair can if appropriate be stripped of insulation.

The STATUS of a "circuit" can be defined as being one of the following:

OPERATIONAL
OPEN
NON OPERATIONAL

For a given "circuit" NON-OPERATIONAL STATUS can be said to exist as a result of a detected short circuit.

OPEN STATUS can be said to exist as a result of a detected open circuit.

If the STATUS of a circuit is neither OPEN nor NON-OPERATIONAL then it can be assumed to be OPERATIONAL. Of course as subsequent tests for short circuits and open circuits are carried out the STATUS of each "circuit" can change.

On the white area of a given line there are two pairs of circuits which enable "in" bounces to be detected:

Y and GW
S and GH.

At least one of these pairs must be OPERATIONAL to enable "in" bounces to be detected.

On the green area of a given line there are two pairs of circuits which enable "out" bounces to be detected:

N and GG
O and GN.

The pair O and GN at least must be OPERATIONAL.

If both "in" and "out" visual indications are required then for a given line at least one of the pairs of the "circuits" required for detection of "in" bounces must be OPERATIONAL and the pair O and GN must be OPERATIONAL. If only "out" indications are required then at least the pair of circuits O and GN must be OPERATIONAL.

If insufficient OPERATIONAL circuits are available on a given line to fulfill the functions required by the system then that line can be referred to as having NON-OPERATIONAL STATUS.

One of the features of one type of system is the capability of checking the individual circuits for continuity and for short-circuits by controlled changes of appropriate voltage levels at one end for example 141 (FIG. 6) of each "circuit" (for example "circuit" Y of FIG. 6) to be tested and determination of the effect of such changes at the other end for example 142 (FIG. 6) of this "circuit" and of other circuits which could erroneously be affected. In such a type of system the ends 141 and 142 of "circuit" Y would not be connected together but would be independently held at say +5 volts. Such checks can be made immediately after a detected valid bounce to assess whether such lines remain operational and if the appropriate line which becomes non-operational can be indicated for example by changing the appropriate disc 20 of the second display 6 (FIG. 1) from "white" to "orange" until the line again becomes operational.

Figure 7A:
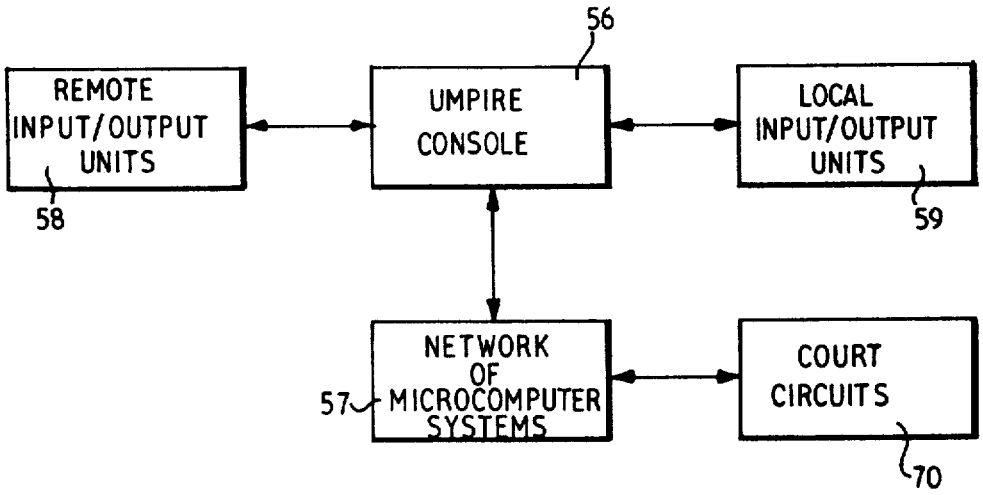
FIGS. 7A and 7B are block diagrams illustrating the adaptability and flexibility of the micro-computer network systems for use with and without an umpire's console respectively; the umpire's console itself can include a mirco-computer.
Figure 7B:
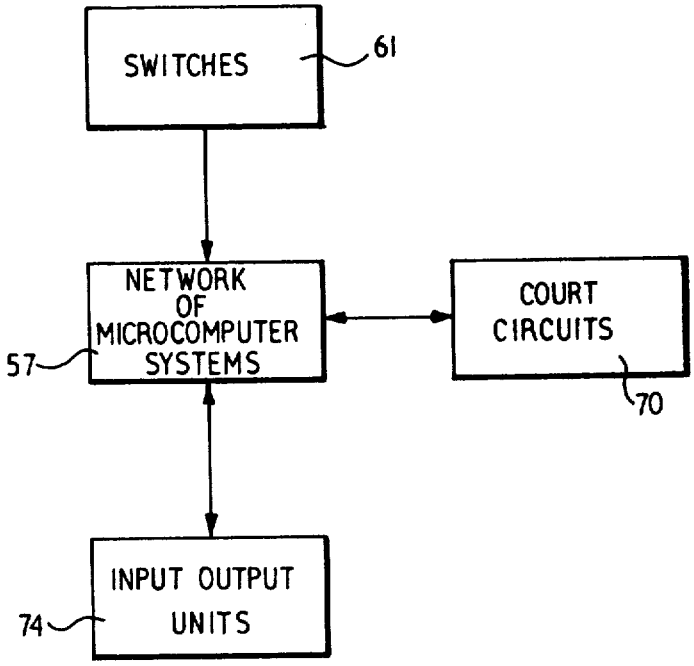

Referring now to FIG. 7 and turning to the adaptability and flexibility of such systems, it will be seen from FIGS. 7A and 7B that such systems can be used either with or without an umpire's console. In the example shown in FIG. 7A, the system is designed to be used with an umpire's console 56. It will be appreciated that one possible example of an umpire's console 56 is illustrated in FIG. 1. In this case, the overall control of the various units shown in FIG. 1 can be effected by one of the micro-computers. The units of the umpire's console can by way of example only be contained within a briefcase and the umpire can use and/or control such a system for making automatic line-call decisions. In cases such as those indicated in FIG. 7A, the umpire's console 56 is controlled by its own micro-computer referred to above and is connected to further micro-computer systems 57 controlling the court circuits 70 as well as to remote input/output units 58 and local input/output units 59. It will be appreciated that one possible layout of court circuits 70 is indicated by FIGS. 2, 3, 4, 5, 6 and 11. Each micro-computer of the micro-computer systems 57 can if required support local input/output units (for example the court circuits 70) and/or remote input-/output units.

The connection between the umpire'console 56 and the further micro-computers 57 can be either direct or via data communications links. The connection between micro-computers within the network or micro-computer systems 57 can in some cases be direct and in other cases be by means of telecommunications links and in yet other cases both methods could be employed.

The block 57 can comprise a network system of micro-computers. When the umpire's console 56 is connected it becomes part of the network system and may indeed control it. The block 57 may contain interconnected micro-computer systems and/or non-interconnected microcomputer systems. Non-interconnected micro-computer systems may nevertheless be interconnectable. In the case where the system is to be used without an umpire's console, the system as shown in FIG. 7B includes the micro-computers 57 and court circuits 70 as in the case of FIG. 7A above. The block 57 may contain interconnected micro-computer systems and/or non-interconnected micro-computer systems. Non-interconnected micro-computer systems may nevertheless be interconnectable. In addition, switches 61 can be provided with a housing which contains the micro-computers 57 whose functional capabilities may differ in some respects from those micro-computers 57 shown in FIG. 7A. The switches 61 can enable the players to switch on and off, to select system facilities and to control the circuits used. Also provided are input/output units (e.g. audio and/or visual units) 74 controlled by the micro-computers 57; these input/output units can be local and/or remote. Switches 61 may be locally or remotely operated by the players. Remote operation may use infra-red or other electromagnetic activation methods or may use sonic or ultra-sonic activation methods. Remote operation of a score indicator may be similarly effected. Opposing players may use different frequencies for remote operations and/or different techniques e.g. one may use an ultra-sonic device and an opponent may use an infra-red device.

Figure 8:
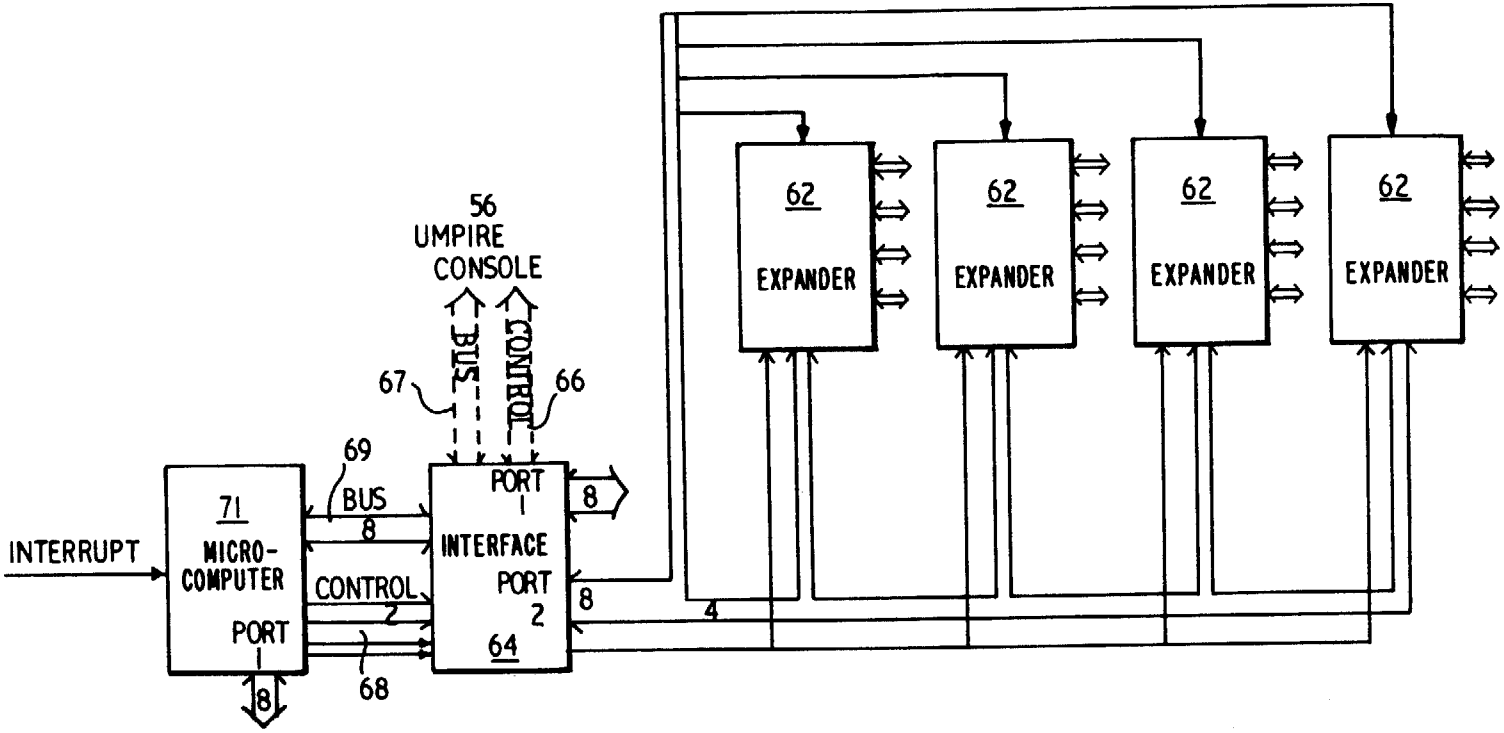
FIG. 8 is a block diagram showing one part of a micro-computer network system and how a system can be adapted for use with or without connection to one form of umpire's console.
Figure 9:
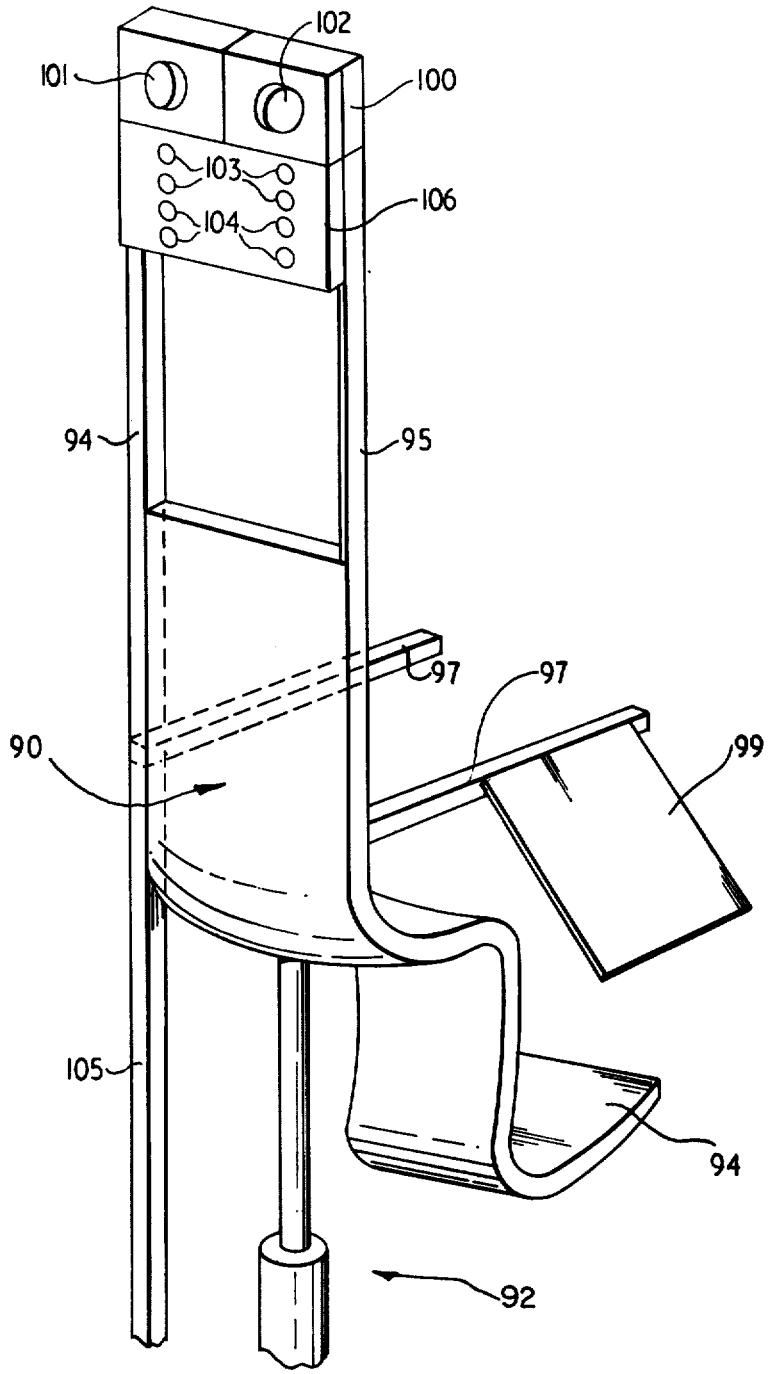
FIG. 9 is a rear perspective view of one preferred form of umpire's chair.
Figure 10:
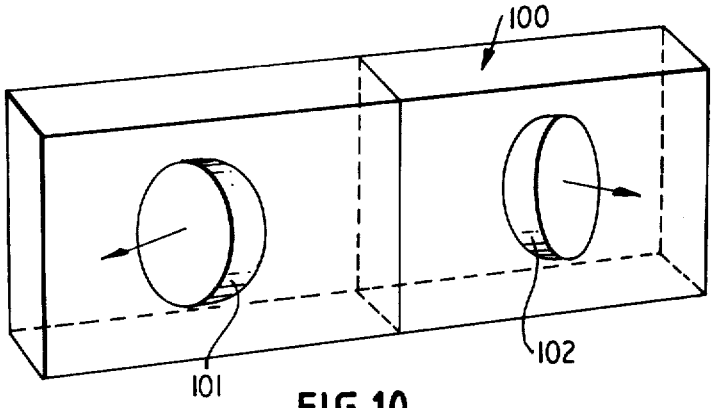
FIG. 10 is a diagrammatic perspective view showing one form of waterproofed lid of one form of umpire's console.

Referring now to FIGS. 7, 8, 9 and 10, one preferred form of an output unit of 74 of FIG. 7B may be housed within the lid 100 (illustrated in FIG. 10) of a brief-case (such as that used to house the umpire's console of FIG. 1). The lid 100 may be locatable as indicated in FIG. 9 for use as a local input/output unit. The lid 100 of FIGS. 9 and 10 can house a pair of loudspeakers 101 and 102 together with their associated amplifiers. Another output unit indicated in FIG. 9 can consist of eight lamps, four lamps 103 coloured for example red and four lamps 104 coloured for example green. All such lamps can be mounted so as to be appropriately and clearly visible to players and spectators. In FIG. 7B a unit containing the loudspeakers and amplifiers is connectable locally to 57 (which may be housed close to a netpost). The housing for the network 57 can also house the switches 61; the network 57 being connected also to the court circuits 70. The loudspeakers can give different audible signals according to whether the ball was automatically detected as having bounced "in" or "out". In cases where a valid ball bounce is detected on two or more lines each of which lines is independently controlled by say non-interconnected micro-computer systems (one instance of 57), then in such cases a valid ball bounce can be regarded by one micro-computer system as "in" and by another micro-computer system as "out". The electronic logic necessary to resolve this situation may be housed in 57 and/or 74 in the case of FIG. 7B. In the case of FIG. 7A such logic can reside in the umpire's console 56 and/or in the micro-computer system 57.

The adaptability and flexibility of such systems is illustrated schematically by way of example in the block diagram of FIG. 8. The network of micro-computer systems 57 can include devices 62 which may be semiconductor devices; a universal peripheral interface 64 which may be a semiconductor device; and a micro-computer 71 which may be a semiconductor device sometimes referred to as a computer on a chip. For the sake of clarity, it will be appreciated that FIG. 8 only indicates a basic building block or module for one kind of implementation of such systems, and in practice there can be a multiplicity of such modules and/or systems. Such micro-computers systems can either operate autonomously and/or they can be interconnected within the network 57 of FIG. 7B and/or FIG. 7A. Such micro-computer systems may be connected to the umpire's console 56 of FIG. 7A. Devices 62 can be input/output expanders which may be semiconductor devices. Each expander 62 can have sixteen available connections e.g. for the circuits on the court. Each expander 62 is connected to the universal peripheral interface 64 which can have the capabilities of a micro-computer and be programmable.

By way of example only the unit 64 may be the Universal Peripheral Interface 8-bit micro-computer 8041A/8071A sold by INTEL CORPORATION under the Trademark UP1-41A. The 8741A is a general purpose programmable interface device designed for use with a variety of 8-bit micro-processor systems. It contains a low cost micro-computer with program memory, data memory, 8-bit CPU input/output ports, timer/counter and clock in a single 40-pin package. Interface registers are included to enable the UPI device to function as a peripheral controller in micro-computer systems using INTEL (Registered Trade Mark) devices known as MCS-48, MCS-80, MCS-85 and MCS-86. UP1-41A is fully compatible with MCS-48, MCS-80, MCS-85 and MCS-86 micro-processor families. 8741A has 18 programmable input/output pins and input/output is expandable with the 8243 device which is directly compatible and has 16 input/output lines. Additional 8741A features include UV erasable EPROM; single 5 V supply; single-step mode for debug; support for DMA (Direct Memory Access), interrupt or polled operation. The universal peripheral interface 64 may be either connected to the umpire's console 56 (this involves use of control and bus-lines 66 and 67 respectively) or to the micro-computer 71 (involving use of control and bus-lines 68 and 69 respectively). In both cases other connections including provision for interrupt facilities will be used.

It will normally be preferable to provide a multiplicity of modules such as that of FIG. 8 and to provide spare input/output connections for other sub-system purposes e.g. foot-fault detection and net-cord decisions. Each micro-computer 71 can also respond to one (or in some cases more than one) external "interrupt" whereby the appropriate micro-computer 71 can be advised immediately of the bridging of circuits on the court due to the bounce of the tennis ball or other contact by electrically conductive object or due to noise or due to input from the "aerials" on the court.

A purpose of providing the external "interrupt" for each micro-computer 71 is to enable the "interrupted" micro-computer immediately to instruct the reading of the ports associated with the expanders 62 within its own system and to take other related actions.

The system shown in FIG. 8 is thus designed to be used either with or without an umpire's console. In the case where it is used without the umpire's console 56, the control and bus lines 66 and 67 are electrically disconnectable.

It will be appreciated from the above description that the universal peripheral interfaces 64 provides a bridge between possible stand-alone use of the network of micro-computer systems 57 and use of the systems 57 in conjunction with an umpire's console 56.

Non-independent systems otherwise functionally similar to that of FIG. 8 may be interconnected (with or without an umpire's console) thus forming different types of networks. Such methods may use telecommunications techniques, equipment and protocols.

Referring again to FIGS. 9 and 10 the court can also be provided with an umpire's chair 90 which is provided with support for his console and which can be mounted on a platform (not shown) by means of a hydraulically operated telescopic cylindrical pillar 92 or alternatively may be positioned by use of a fork lift. The chair 90 can support the console 56. The chair 90 can additionally include an adjustable foot rest portion 94, a pair of arms 97, a movable support 99 secured to one of the arms 97, and a pair of vertically arranged members 94 and 95 extending from either side of the back rest of the chair 90. The lid 100 of the briefcase (FIG. 10) may be attached to these members 94 and 95 which may also support the lamp unit 106 containing the lamps 103 and 104. Electrical connection of the loudspeakers 101 and 102 as well as the lamps 103 and 104 to an umpire's console 56 and/or to 57 can be via the telescopic housing 105 and the arm 97. The court circuits are connectable to an umpire's console 56 via the telescopic housing 105 and the arm 97. Two of the green lamps 104 can indicate that the ball has been detected by the system as having bounced "in" when in play on the corresponding side of the court whilst two of the red lamps 103 can be used to indicate the ball has been detected by the system as having bounced "out" on that side of the court.

The operation of the umpire's chair 90 is as follows: The chair is lowered hydraulically. The umpire sits in the chair and secures the support 99 to the left-hand arm 97 so as to lock himself safely in. An umpire's console 56 can be locked in position on the support 99, electrically connected, and the hydraulics operated to raise him to a desired height where he will have a commanding view of the whole tennis court. The removable lid of a console 56 can include amplifiers in the unit 100 and the loudspeakers 101 and 102. A system using an umpire's console can store, update and print information concerning for example the players; previous matches involving the players; the tournament; prize money; players competitive rankings; date; court number; court surface; the balls used.

Figure 11A:
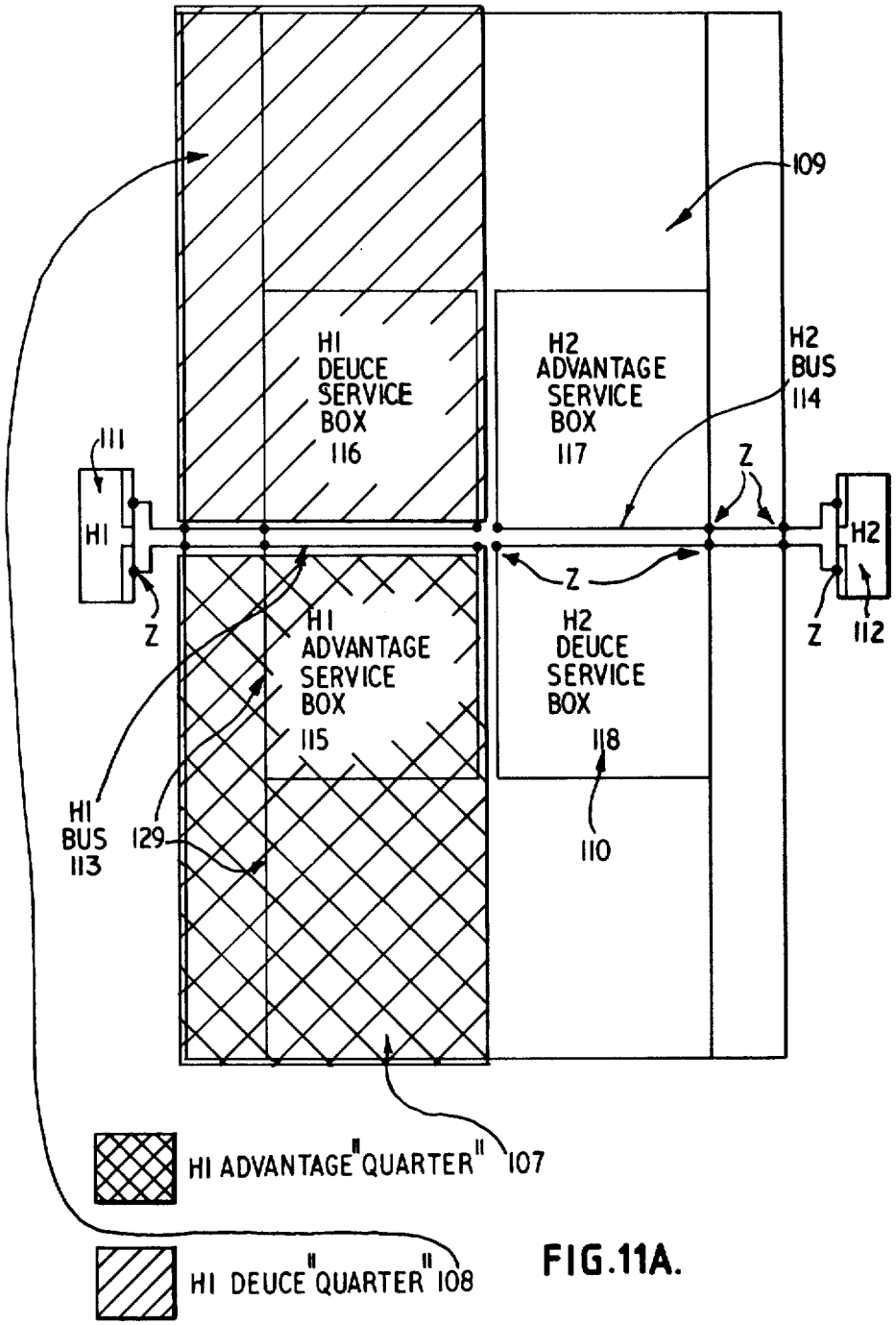
FIGS. 11A and 11B are diagrams representing an example layout of court circuits and an example positioning of housings H1 and H2 which can be used when no linesmen and no umpire are available.
Figure 11B:
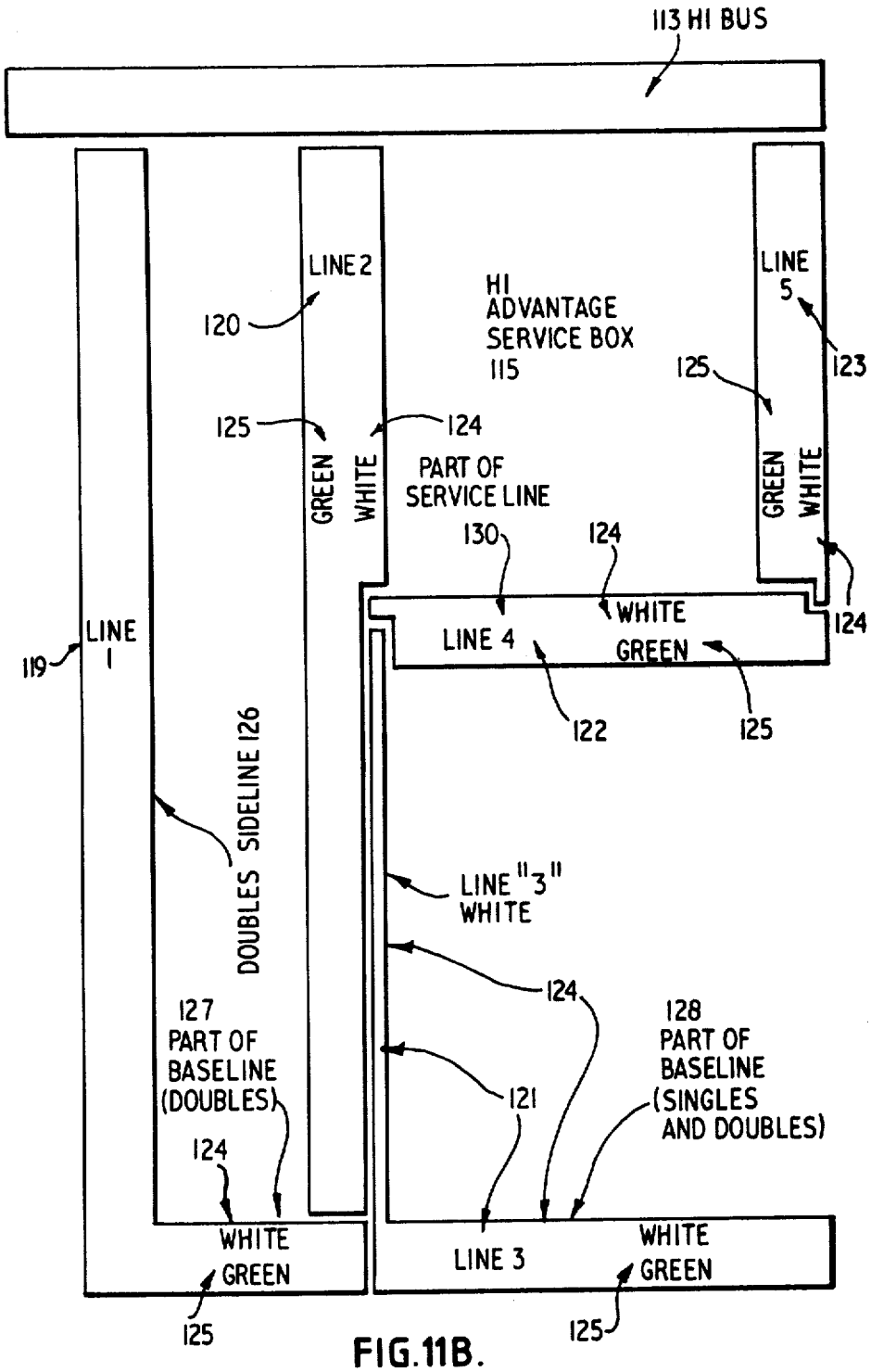

Referring now to FIG. 11, which shows a schematic of the layout of electrical circuits for a tennis court, different details are illustrated in FIGS. 11A and 11B.

Figure 12:
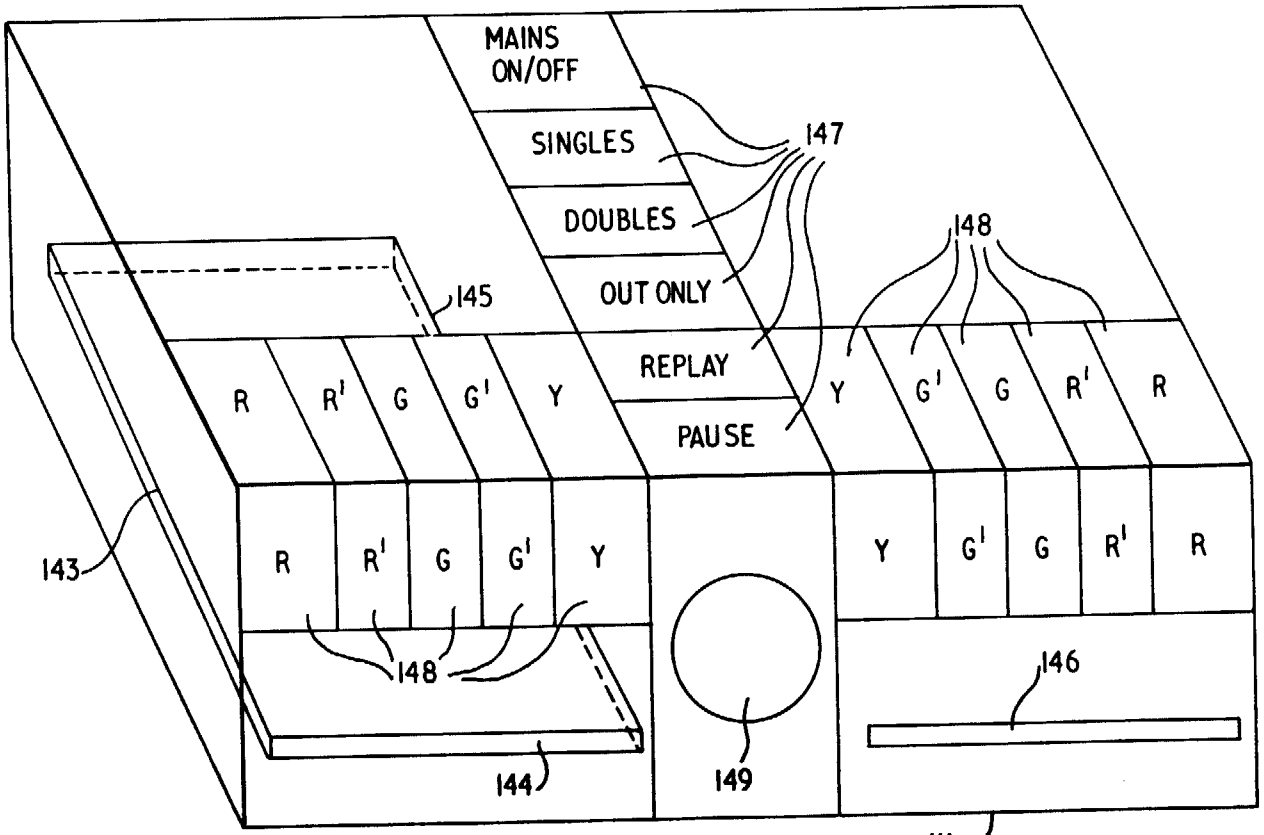
FIG. 12 is a diagram representing a housing such as H1 which can incorporate switches and audio and visual indicator means as well as micro-computers and connectors for connection of said micro-computers to court circuits.

FIG. 11A shows schematically a tennis court, the electrical circuits for which are divided into four ideally identical QUARTERS 107, 108, 109 and 110. FIG. 11A illustrates schematically:

(a) a general layout into four QUARTERS 107, 108, 109, 110 for electrical circuits for a tennis court;

(b) housings 111 and 112 (H1 and H2 respectively) (see FIG. 12);

(c) busses 113 and 114 (H1 and H2 respectively).

Such a general layout of electrical circuits for a tennis court can be used as part of:

(a) a system providing automated line-call decisions in tennis wherein an umpire operates an umpire's console such as that of FIG. 1;

(b) a system providing automated line-call decisions in tennis wherein no umpire and no linesmen are essential and wherein automated line-call indications are provided for the players at the housing 111 (H1) and/or 112 (H2) (see FIGS. 11 and 12).

The housings 111 (H1) and 112 (H2) can be identical. Each such housing, for example the H1 housing 111, can control two of the four ideally identical QUARTERS of the court illustrated in FIG. 11A. The H1 housing 111 can include two ideally identical micro-computers, such that one of these micro-computers controls the H1 DEUCE QUARTER 108 and the other controls the H1 ADVANTAGE QUARTER 109. Electrical connections between a micro-computer in the H1 housing 111 and the QUARTER it controls are via the H1 BUS 113. Such connections are in general not indicated in FIG. 11A (or in FIG. 11B). Control switches and indicator means common to both micro-computers in the H1 housing 111 can also be included in the H1 housing 111. The busses illustrated in FIG. 11A comprise:

(a) the H1 BUS 113;

(b) the H2 BUS 114.

Ideally these busses can be identical and can consist of woven flat ribbon cable or other convenient construction which includes electrically conductive "channels" (referred to in relation to FIGS. 3, 4 and 5).

As an alternative only one BUS need be used to provide the functions of the H1 BUS 113 as well as the H2 BUS 114.

As a further alternative four BUSSES could be used to provide the functions of the H1 BUS 113 and H2 BUS 114.

The woven flat ribbon cable or other construction providing the H1 BUS 113 can be similar or identical to the woven flat ribbon cable or other construction providing the electrical circuits of the tennis court QUARTERS 107, 108, 109 and 110.

Division of electrical circuits introduced into a tennis court into a number of ideally identically equal parts (e.g. QUARTERS) other than QUARTERS can also be made, including the case where the number of parts is one.

In FIG. 11A no tennis court net is indicated above the H1 BUS 113 and H2 BUS 114.

In FIG. 11A the H1 ADVANTAGE QUARTER 107 includes an H1 ADVANTAGE SERVICE BOX 115: this BOX 115 includes the area of the court in which a served ball may validly bounce when for example served from the far side of the net into that BOX 115 with the score in the tennis match at ADVANTAGE (to either side). Normally, balls served during a given game of a tennis match are at each increment of the score directed alternately by way of example to the DEUCE SERVICE BOX 118 and the ADVANTAGE SERVICE BOX 115. By way of further example if services are being served from the other end of the court then as the score is incremented serves are commonly directed alternately to 116 and 117. The H1 housing 111 can control the H1 ADVANTAGE QUARTER 109 (including the H1 ADVANTAGE SERVICE BOX 115) and the H1 DEUCE QUARTER 108 (including the H1 DEUCE SERVICE BOX 116).

In FIG. 11A some electrical connections between the micro-computers in the housings 111 and 112 and circuits on the court via respectively the BUS 113 and the BUS 114 are indicated by the use of dots marked Z.

Referring now to FIG. 11B, which illustrates in more detail a layout of electrical circuits introduced into a tennis court for one QUARTER (the H1 ADVANTAGE QUARTER 107) only of such a court, it can be seen that each of the fives LINES (LINE 1 (119), LINE 2 (120), LINE 3 (121), LINE 4 (122), LINE 5 (123)) comprises green and white areas (referred to in relation to FIG. 3). FIG. 11B also indicates the approximate position of the H1 BUS 113 in relation to the aforesaid five LINES 119 to 123.

White circuitized areas 124 of each LINE are introduced into the tennis court so as to correspond to all or part of one or more of the white lines commonly used to mark out the playing areas of a tennis court.

Green circuitized areas 125 of each LINE are introduced into the tennis court to assist in the provision of automated line-call decisions when a ball bounces on or close to a white line used to mark out the playing areas of a tennis court.

Just as the playing areas of tennis courts can be marked out by methods not using white lines, so the five LINES can be correspondingly modified.

In FIG. 11B the white areas 124 of a given LINE can be about 25.5 mms in width and the green areas 125 of a given LINE can be about 136.5 mms in width. The lengths of the white and green areas of a given LINE are not necessarily equal as illustrated in FIG. 11B.

Considering only the white areas 124 of the five LINE in FIG. 11B it can be arranged that:

LINE 1 (119) corresponds to a doubles sideline 126 plus that part of the baseline 127 also used in doubles matches.

LINE 2 (120) corresponds to part of the H1 ADVANTAGE SERVICE BOX 115 as well as to part of a singles sideline 129 (see FIG. 11A).

LINE 3 (121) corresponds to most of the remainder of the same singles sideline (12) plus part of the baseline used for both singles and doubles matches (128).

LINE 4 (122) corresponds to part of the H1 ADVANTAGE SERVICE BOX 115 and to part 130 of the service line and to part of the singles sideline 129.

LINE 5 (123) corresponds to part of the H1 ADVANTAGE SERVICE BOX and to part of the H2 DEUCE SERVICE BOX and to part of the centre service line.

In FIG. 11B no electrical connections are indicated and indeed none of the "channels" (referred to in relation to FIG. 3) is indicated, but it is to be assumed that all electrical circuits from the tennis court including for example those from the H1 ADVANTAGE QUARTER 107 are electrically connected via a BUS to a micro-computer in a housing.

Referring now to FIG. 12 a further example will be given of a system using a court layout like that indicated in FIGS. 2 and 11, but using court circuits exploited differently from the method discussed in relation to FIG. 8 and with different micro-electronics modules for control (and indication) purposes. FIG. 12 illustrates the H1 housing 111 (see also FIG. 11A) which combines the functions of blocks 57, 61 and 74 of FIG. 7B and provides for connections to and control of court circuits for the H1 ADVANTAGE QUARTER 107 and for the H1 DEUCE QUARTER 108 illustrated in FIG. 11A. The housing 111 can house two identical micro-computers only one of which (143) is indicated. The micro-computer 143 indicated is a single board computer of which only the board is illustrated (no components or semi-conductor devices are shown) but equivalent functions could be fulfilled by several boards of devices. The single board computer 143 can have edge connections 144 and 145 for example. The edge connections 144 can be connected to court circuits in the H1 ADVANTAGE QUARTER 107 (see FIG. 11A). Similarly the edge connections 146 from the other single board micro-computer (not shown) identical to 143 could be connected to court circuits in the H1 DEUCE QUARTER 108 (see FIG. 11A). The two micro-computers can be connectable using telecommunications or other techniques. The edge connections 145 can be connected to a Ball Tester described in my British Specification No. 1,602,450 and also in my U.S. patent application Ser. No. 866,492, now abandoned, and used for testing the electrical conductivity of tennis balls. The housing 111 of FIG. 12 can combine the functions of blocks 57, 61 and 74 of FIG. 7B. By way of example switches 147 are indicated in connections with functions labelled MAINS ON/OFF; SINGLES; DOUBLES; OUT ONLY; REPLAY; PAUSE. By way of further example local visual output units such as lamps 148 are indicated in connection with colours labelled R and R' (red); G and G' (green); Y (yellow). By way of further example a local audio output unit 149 is indicated and this unit will include a loudspeaker and a corresponding amplifier. Thus the housing 111 combines functions indicated in FIG. 7B as NETWORK OF MICRO-COMPUTER SYSTEMS (57); SWITCHES (61); INPUT/OUTPUT UNITS (74). In addition the housing 111 provides for connections to court circuits (see FIG. 7B and block 70). The micro-computer 143 can be a single board computer or the same functions could be carried out by a number of boards of appropriate components and devices. Such a set of boards would be interconnectable by means of a chassis with appropriate connectors or "slots". For the present purposes of automating line-call decisions in tennis and by way of example only the functions of micro-computer 143 could be largely carried out using one or more modules sold by Texas Instruments Incorporated with the following designations:

TMS 990/510
TMS 990/100M-3
TMS 990/310
TMS 990/301, plus appropriate RAM (random access memory) EPROM (erasable programmable read only memory) and power supplies. The above excludes lamps, switches, loudspeaker, amplifier and two further modules referred to in relation to FIG. 13 as TENNIS MODULE and LEVELS MODULE.

TMS 990/510 refers to a chassis with four slots for four boards. Eight slot chassis can also be obtained (TMS 990/520).

TMS 990/100M-3 refers to the micro-computer on a board.

TMS 990/310 refers to an input/output module.

TMS 990/301 refers to a MICRO-TERMINAL which looks externally rather like a pocket calculator. This terminal can be used for interaction with the computer system.

Still referring to FIG. 12 the system housed in two housings 111 and 112 (see FIG. 11A) can provide automatic line-call indications without necessitating the presence of any linesman or umpire; when the connections between the court circuits and the housings 111 and 112 are made, the players need only walk on to the court, switch on and start playing. The switch on process involves switch 147 actions selecting:

MAINS ON
SINGLES OR DOUBLES
OUT ONLY if only OUT indications are required.

During the course of the tennis match the players can request a repeat of the last indication given by the system by means of switch 147 action consisting of:

activating PAUSE and then
activating REPLAY.

When the players at switch on or subsequently activate OUT ONLY as may be indicated by a corresponding light or by switch position, then the system will provide audio/visual indications to the players only if valid "out" bounces of an electrically conductive ball are detected on the court circuits. However, by way of example only, a given valid ball bounce can occur at the extreme white end of LINE 3 (FIG. 11B) where it touches (the FIG. 11B is not accurate in this respect) LINES 2 and 4. If this valid boune corresponds to a service then it is "out", but if it corresponds to say SINGLES play, then it is "in". With OUT ONLY activated the system can indicate this situation by both audible and visual indications. For example, such a system can be arranged so that audible indications occur in any case only for valid "out" bounces. Different audible signals can be provided for "out" for service and singles (or doubles) situations. When only valid "out" bounces are indicated by the system the corresponding visual indications can use the lamps 148 marked R, R' (for red).

When the system is required by virtue of OUT ONLY being deactivated to indicate both "in" and "out" valid bounces, it can be arranged that "in" indications are given only visually, whereas "out" indications are given both audibly and visually (as previously described for OUT ONLY activated). Visual "in" indications can be given with the aid of the lamps 148 marked G, G' (for green).

The lamps 148 marked Y in FIG. 12 can be used to indicate detected malfunction of court circuits.

By way of further example of facilities which can be provided with such a system for automated line-call decision in tennis, a micro-computer speech module TM990/306 also sold by Texas Instruments Incorporated can be incorporated. The speech module TM990/306 is a bus compatible member of the TN990 product family and is capable of generating speech from a self-contained data set. The module contains a fixed vocabulary from which phrases or sentences can be constructed. Additional words can be added to the vocabulary by Texas Instruments Incorporated and a vocabulary appropriate for generating spoken automated line-call decisions in tennis can be provided. Such a vocabulary for tennis can include words such as: OUT; LONG; WIDE; FAULT; ERROR; LOVE; ALL; FIFTEEN; THIRTY; FORTY; DEUCE; ADVANTAGE; GAME; SET; MATCH; PLAY; LET; TIE; BREAK; ONE; TWO; THREE; FOUR; FIVE; SIX; SEVEN; EIGHT; NINE; TEN; ELEVEN; TWELVE; THIRTEEN; FOURTEEN; (and other numbers); SERVICE; FOOT; DOUBLE; FIRST; NET; SUGAR. Words in languages other than English can be provided e.g. TOUT; SEPT (French). Words from different languages e.g. French and English can be provided in combination.

Speech generation hardware capability provided by manufacturers other than Texas Instruments Incorporated can also be used. By way of example the ITT Speech Generator VLSI MOS IC (Very Large Scale Integration, Metal-Oxide-Silicon, Integrated Circuits) can be used.

Figure 13:
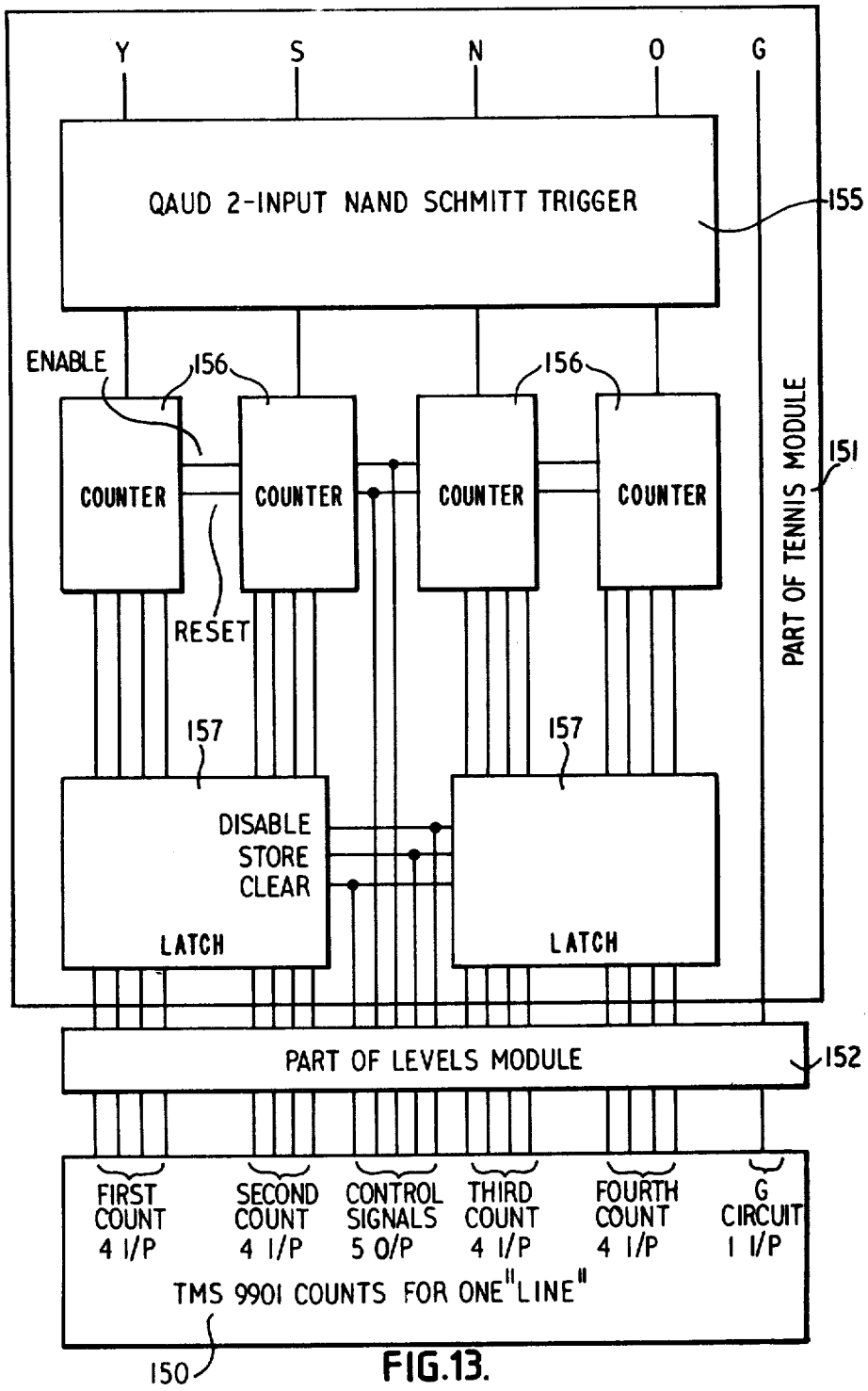
FIG. 13 is a diagram representing schematically devices which can by way of example be used for line termination and signal conditioning (with respect to court circuits) and for counting low to high volts level transitions of court circuits contacted by a bounce of an electrically conductive tennis ball. This diagram represents schematically an example of an interface between court circuits and a micro-computer.

Referring now to FIG. 13, this illustrates by way of example only the connection for one line e.g. LINE 5 (see FIG. 11B) of court "circuits" Y, S, N, O (discussed in relation to FIG. 4) and of court "circuits" connected to G (discussed in relation to FIG. 5) to the edge connectors (e.g. 144-see FIG. 12) and then via the so-called TENNIS MODULE 151 and LEVELS MODULE (mentioned in relation to FIG. 12) 152 to a TMS 9901 (150) programmable systems interface chip. The TMS 9901 is sold by Texas Instruments Incorporated and is a multi-functional component which provides interrupt and input/output ports and an interval timer for TMS 9900 family micro-processor systems. The TMS 9900 microprocessor is sold by Texas Instruments Incorporated and is a single chip 16 bit central processing unit.

The TMS 9900 is incorporated into the TMS 990/100M-3 module discussed in relation to FIG. 12. The TMS 9901 is incorporated into the TMS 990/310 module discussed in relation to FIG. 12. Both TMS 9900 and a number of TMS 9901 can be incorporated into the single board computer 143 discussed in relation to FIG. 12. FIG. 13 indicates one such TMS 9901 indicating schematically input/output connections (I/P or O/P) only.

The LEVELS MODULE 152 can enable selection for a given line say LINE 5 (FIG. 11B) of a first voltage level for "circuits" Y, S, N, O and simultaneously of a second voltage level for "circuits" G. The LEVELS MODULE can also be commanded to reverse these voltage levels so that the first voltage level is applied instead to G "circuits" and concurrently the second voltage level is applied instead to the Y, S, N, O "circuits". Such a command can be either manually or automatically provided. The LEVELS MODULES 152 can also be commanded to disconnect "circuits" from all stabilized voltage sources.

The LEVELS MODULE 152 can also be commanded to effectively disconnect the TENNIS MODULE 151 and instead to connect the Ball Tester (discussed in relation to FIG. 12) using the edge connectors 145.

By way of example only such a system could be arranged so that manual commands can be provided to the system via the TMS 990/301 MICRO-TERMINAL (discussed in relation to FIG. 12).

Figure 14:
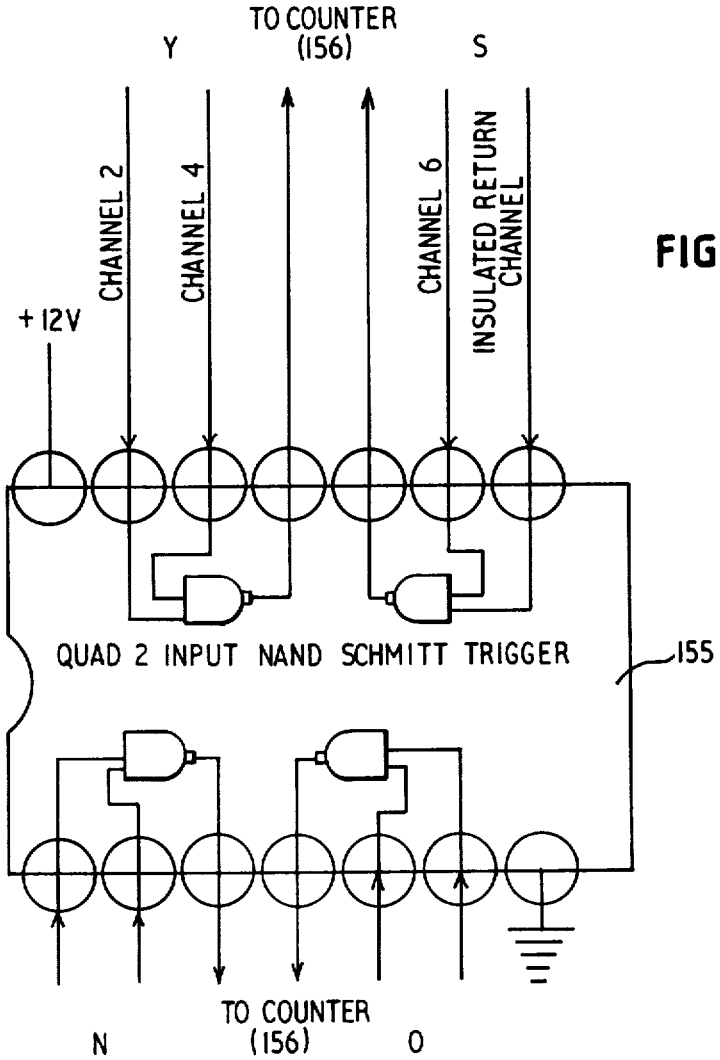
FIG. 14 is a diagram representing schematically by way of example detail of a QUAD 2-INPUT NAND SCHMITT TRIGGER device which can be used as indicated in FIG. 13.

The TENNIS MODULE 151 can provide line termination and signal conditioning. When interrupts are detected on one or more lines of say the H1 ADVANTAGE QUARTER 107 then such a system can be arranged so that by way of example channels 2 and 4 ("circuit" Y) of that line (e.g. LINE 5-see FIG. 11B) are normally high (e.g. at +5 volts) relative to the G rail (e.g. at zero volts). A conductive ball bouncing on one or both of channels 2 and 4 as well as on say "circuit" G/GW will then cause channels 2 and 4 to be pulled low (i.e. normally to zero volts like the stabilized grounded G rail). Referring now to FIGS. 13 and 14 channels 2 and 4 can be connected to say a QUAD 2-INPUT NAND SCHMITT TRIGGER 155 which can respond in such a way that if either or both inputs from channels 2 and 4 are low then its output will be high. On the other hand if both inputs are high the output will be low. Such a device can be suitable for conditioning noisy input levels. The outputs from 155 can be used as inputs to counters 156 whose function is to count the number of low to high transitions input from each of the "circuits" Y, S, N and O. Referring now to FIG. 13 the outputs from the counters 156 can be used as inputs to corresponding latches 157. These latches 157 can hold the count values and can be interrogated at appropriate times by a TMS 9901 (150) and subsequently used for analysis by a micro-computer system.

A TMS 9901 can output control signals for purposes such as to ENABLE and RESET a counter and to DISABLE, STORE and CLEAR a latch.

A TMS 9901 can input digital information corresponding to counts and to the volts level (high or low) of the G volts rail.

Referring now to FIG. 15 it will be appreciated that during the total elapsed contact time of a valid tennis ball bounce on one or more lines (such as LINE 5 FIG. 11B) which elapsed contact time is often of the order of milliseconds, there can occur of the order of hundreds or a thousand or so circuit completions and breaks by virtue of the conductive ball making and breaking connections between circuits on the court.

FIG. 15 is a series of graphs drawn from photographs taken using a TEKTRONIX 466 100 MHZ storage oscilloscope and a C-5C polaroid camera of particular bounces of particular conductive tennis balls on particular circuits.

Figure 15A:
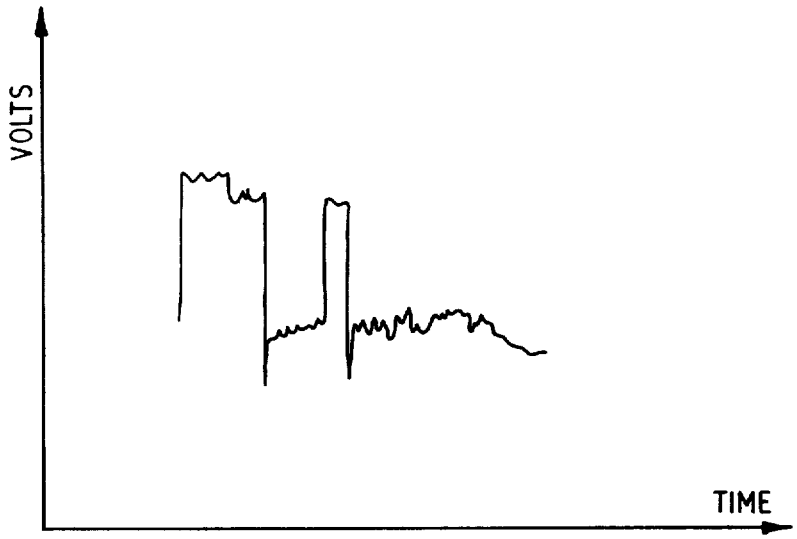
FIGS. 15A, 15B, 15C, 15D, 15E and 15F are graphs representing different aspects of low to high (and high to low) volts transitions of circuits contacted by a bounce of an electrically conductive tennis ball. The volts scale of each Figure is about 8 volts along the total vertical axis.

FIG. 15A is a graph showing the first 9 microseconds of a particular bounce of a particular conductive tennis ball on a particular circuit.

Figure 15B:
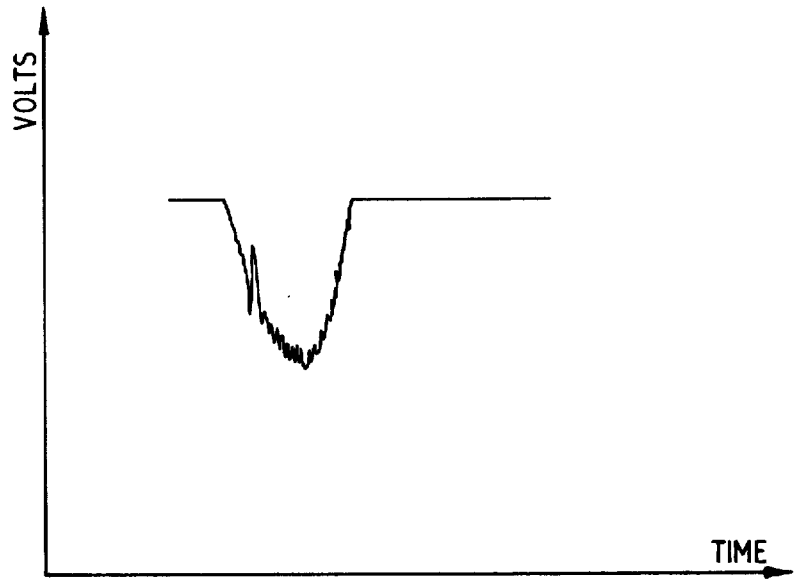
Figure 15C:
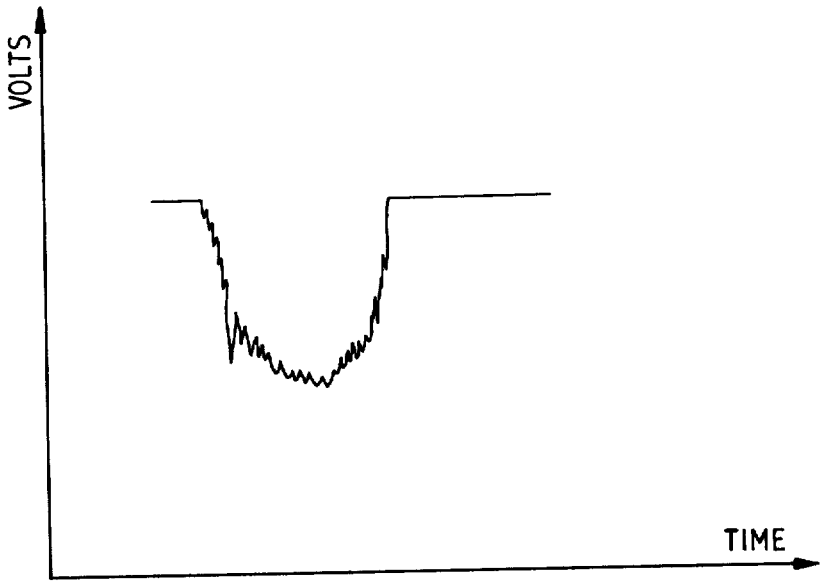

FIGS. 15B and 15C are graphs showing total elapsed contact time of approximately 3.5 milliseconds and 5.0 milliseconds respectively for particular bounces.

Figure 15D:
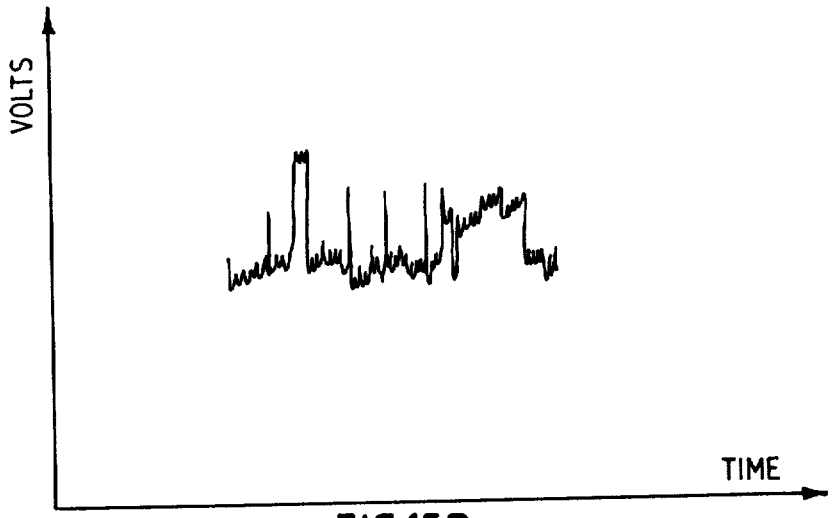
Figure 15E:
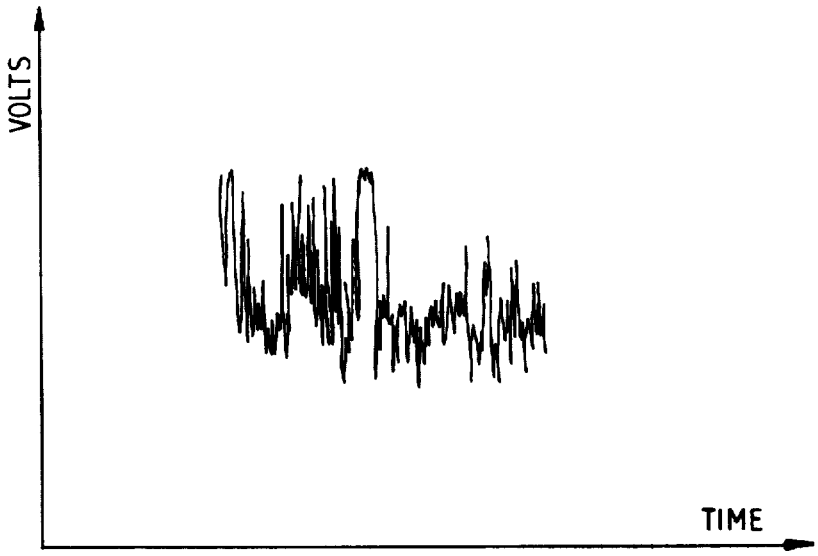
Figure 15F:
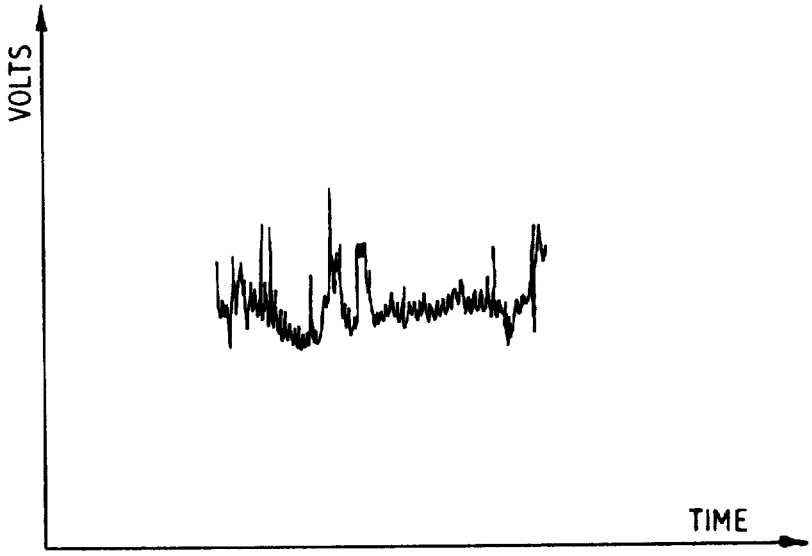

FIGS. 15D, 15E and 15F are graphs showing 18 microseconds excerpts which occurred at some time during particular bounces.

It will be appreciated that a multiplicity of observations and measurements can be made and that values can, by way of example only, be determined for:

(a) the minimum and maximum numbers of low to high transitions (referred to in relation to FIGS. 13 and 14) on a given "circuit" (such as "circuit" Y referred to in relation to FIGS. 4, 6, 13 and 14) during a given time period such as 750 microseconds;

(b) the maximum number of low to high transitions which can be caused by one valid ball bounce;

(c) the minimum number of low to high transitions which can be caused by one detected valid ball bounce;

(d) the maximum number of lines (such as LINE 5 FIG. 11B) which can be contacted by one valid ball bounce; and (e) the permissible or possible combinations of lines (such as LINE 5 FIG. 11B) which can be contacted by one valid ball bounce.

It will be appreciated that a number of characterizing features can be determined and used by a microcomputer system as a type of "fingerprint" check on the validity or otherwise of suspected ball bounces and as a means of enabling automatic distinction between a valid ball bounce and events caused by for example:

(a) a steel racket contacting court circuits;

(b) aerial effects;

(c) electrically induced noise; and (d) an electrically conductive shoe.

It will be further appreciated that similar techniques can be applied to the characterization of bounce contacts of electrically conductive sports balls on suitably circuitized sports surfaces. By way of example these techniques can be applied to bounce contacts of electrically conductive sports balls used in sports such as football, cricket, tabletennis, golf, squash, snooker, pool and racketball.

A network system of microcomputers can detect and analyze characterizing features of for example a suspected tennis ball bounce on court circuits and compare the results obtained from a given bounce with information stored within the system. This information can be updated as a result of further information concerning factors which can affect such characterization, for example surface conditions of the court; condition of the balls; ball deformations; playing conditions.

Naturally it can never be ruled out that for example unlikely, but possible, effects due to other than a valid ball bounce will nevertheless possess as far as a particular microcomputer system implementation is concerned all the checked characteristics of a valid ball bounce. The range of characterizing features available as system checks can however satisfactorily obviate such unlikely events.

A number of events likely to interfere with such a microcomputer system are obvious and can be obviated by appropriate system design, for example:

(a) short circuits caused by other than a valid ball bounce;

(b) open circuits;

(c) aerial effects;

(d) noise;

(e) tennis balls which are inadequately electrically conductive; and (f) a single break in a court circuit.

By way of example only, a break at a single point in a court circuit such as "circuit" Y referred to in connection with FIGS. 4, 6, 13 and 14 can be rendered effectively invisible to the system by connecting both ends of Y independently to the same stabilized volts supply (e.g. +5 volts).

Referring again to FIG. 8 information concerning a suspected ball bounce on court circuits can be detected and subjected to "fingerprint" checks. For example one or more initial interrupts received ostensibly as a result of a ball bounce on court circuit(s) can cause a clock to be started by a microcomputer 71. The microcomputer can then determine which ports of 62 and/or 64 and/or 71 should be read and causes them to be read. When inspection of the data read indicates that the cause of the interrupt(s) has gone, the clock can be stopped (and can in any case be stopped after a predefined time period say 10 milliseconds). Checking of the information input in respect of the characteristics of a valid ball bounce can be carried out and an automatic decision reached and indicated as appropriate.

The detection and recognition of patterns of electrical circuit makes and breaks characteristic of a bouncing electrically conductive tennis ball when bouncing on electrical conductors as described in the above examples, constitute a specific example of a solution to the more general problem of distinguishing automatically the valid bounce of a tennis ball from detected effects arising from other causes.

A system has been described for making automated decisions in tennis including electrical circuits which can be made or broken by a tennis ball bouncing in a zone of a court being monitored and means, operating on a pattern recognition basis, for distinguishing between a valid bounce of said tennis ball and effects arising in said electrical circuits from other causes.

Other systems can be defined which also operate on a pattern recognition basis to distinguish a valid tennis ball bounce from other events, which systems do not require that the tennis ball be electrically conductive. Such systems can by way of example use electro-magnetic, gravitational and/or acoustic detection means.

By way of example a number of parallel electro-magnetic (e.g. infra-red) beams can be detected by a corresponding number of detectors such that the presence of an infra-red beam at a detector causes one circuit action, whilst its absence causes a second circuit action. A valid tennis ball bounce can cause a multiplicity of said second circuit actions which can be analyzed, with respect to say to time sequence, frequency and number, in such a way as to enable the system normally to automatically differentiate a characteristic valid ball bounce from a players body or racket or sweat or rain or from a bird or other object interrupting the beams.

In order to distinguish a tennis ball from say a tennis racket pattern recognition can be used; the detectable pattern of makes and breaks caused by a tennis ball interrupting a plurality of infra-red beams will in many cases be distinguishable from other events although such a method is naturally less specific than when an electrically conductive tennis ball bounces on and directly makes contact with electrical circuits included with the court since the vibrational characteristics of the bounce and the conductive nature of the ball provide additional information for a pattern recognition process.

By way of further example it is in principle possible to detect seismographically the bounce of a tennis ball and again in principle it is possible to differentiate the bounce of a tennis ball from the steps of a tennis player (or other detectable contacts) by analysis of the characteristics of these events as detected by a plurality of seismographs. The nature of the tennis court and the positioning of the seismographs will be important. By way of further example the acoustic features detectable when a tennis ball bounces can in principle be differentiated from those detectable when for example a racket strikes a tennis ball or a player runs around a tennis court or spectators clap, since there will be characteristic frequencies, timings, sequences and intensities associable with a valid bounce of a tennis ball and distinguishable from other events. The tennis court construction and the positioning of the acoustic detectors (e.g. microphones) will be important.

It is necessary to distinguish a valid bounce of a tennis ball from other detectable events in order to be able to provide satisfactory automated line-call decisions in tennis.

A "valid" bounce implies a bounce of a tennis ball in conformity with the rules of tennis in force. For example a tennis ball which is stationary for a minute does not constitute a bouncing ball; again a tennis ball which rolls along in contact with the ground for ten seconds does not constitute a bouncing ball. The contact durations and contact areas are examples of significant factors in determining the validity of a bounce.

If satisfactory automated "let" (or net-cord) decisions are required in a tennis match then it would be necessary to differentiate the characteristics of valid contacts of a served tennis ball with the net from other detected contacts with the net.

In the appended claims "action" is intended to cover not only the bounce of a tennis ball, but also the striking of the net by a tennis ball, the rolling of a tennis ball along the surface of the court, or its flight through the zone being monitored.

I claim:

1. A system for making automated decisions in tennis including: electrical circuits which can be switched by means of a tennis ball action in a zone being monitored; and means operating on a pattern recognition basis for recognizing said tennis ball action in distinction from other events by analyzing at least the frequency of switchings at least in one of said electrical circuits.

2. A system according to claim 1 including means for operating the system without umpire or linesmen.

3. A system according to claim 2 including at least one housing containing at least one micro-computer; input/output units; switches operable by the players; and connection means to enable connection to electrical circuits included with a tennis court.

4. A system according to claim 1 including means for operating the system by an umpire.

5. A system according to claim 4 including an umpire's console; at least one micro-computer; input/output units; and connection means to enable electrical connection to electrical circuits included with a tennis court.

6. A system according to claim 5 wherein said umpire's console includes a portable case having a detachable lid; said case being designed to rest on a support carried by the arms of an umpire's chair; and said detachable lid being deployable on other supports of said umpire's chair.

7. A system according to claim 1 including means to indicate said automated decisions.

8. A system according to claim 1 including means to indicate said automated decisions visually and/or audibly.

9. A system according to claim 1 including means to indicate said automated decisions by generated speech.

10. A system according to claim 9 wherein said generated speech is in English.

11. A system according to claim 9 wherein said generated speech is in a language other than English.

12. A system according to claim 9 wherein said generated speech is in a combination of languages.

13. A system according to claim 1 including means to switch said electrical circuits on or off.

14. A system according to claim 1 wherein said electrical circuits include one or more semi-conductors.

15. A system according to claim 1 wherein said electrical circuits are included with a tennis court.

16. A system according to claim 1 wherein said electrical circuits are incorporated into a tennis court.

17. A system according to claim 1 wherein said tennis ball is electrically conductive.

18. A system according to claim 1 wherein said action is a bounce of said tennis ball.

19. A system according to claim 1 wherein said zone is used for playing tennis.

20. A system according to claim 1 wherein said means operating on a pattern recognition basis analyzes each of the following:

(a) the duration of switching of said electrical circuits;
(b) the number of said switchings in a given time period;
(c) the number of said electrical circuits switched in a given time period;
(d) the sequence of said switching; and
(e) the combination of said electrical circuits switched.

21. A system according to claim 1 wherein said other events include at least one of the following:

(a) a conductor other than an electrically conductive tennis ball influencing said electrical circuits;
(b) a non-conductor other than said tennis ball influencing said electrical circuits;
(c) events not influencing said electrical circuits;
(d) a steel racket contacting said electrical circuits;

(e) an electrically conductive shoe contacting said electrical circuits;

(f) aerial effects influencing said electrical circuits; and (g) noise influencing said electrical circuits.

22. A system according to claim 1 wherein said electrical circuits are included with a tennis court and wherein an electrically conductive tennis ball can switch a plurality of said circuits by bouncing within said zone, whereby said means operating on a pattern recognition basis can distinguish between a bounce of said electrically conductive tennis ball and said other events.

23. A system according to claim 1 including: an electrically conductive tennis ball; a plurality of micro-computers interconnectable to form a network of micro-computers, said circuits being connectable to the micro-computer network system; at least one local and/or remote input/output units being connectable to said micro-computers; and means for arranging said micro-computer network system to be capable of operation either with or without umpire and linesmen whereby a bounce of said electrically conductive tennis ball on said electrical circuits can be detected by said network of micro-computers and "in"/"out" decisions indicated by at least one of said output units.

24. A system according to claim 1 including means for switching said electrical circuits by said tennis ball action on a plurality of electro-magnetic radiation beams.

25. A system according to claim 24 wherein said electro-magnetic radiation beams are infra-red.

26. A system for making automated decisions in a sporting game in which an object is employed in the playing of the game including: electrical circuits which can be switched by means of the action of said object in a zone being monitored; and means operating on a pattern recognition basis for recognizing said action of the object in distinction from other events by analyzing at least the frequency of switchings at least in one of said electrical circuits.

27. A system according to claim 26 wherin said object is electrically conductive.

28. A system according to claim 26 wherein said means operating on a pattern recognition basis analyzes each of the following:

(a) the duration of switching of said electrical circuits;

(b) the number of said switchings in a given time period;

(c) the number of said electrical circuits switched in a given time period;

(d) the sequence of said switching; and (e) the combination of said electrical circuits switched.

29. A system according to claim 28 wherein said object is electrically conductive.

30. A computer system for making automatic decisions in tennis, said system comprising in combination; a plurality of tennis balls, each said tennis ball having a cloth cover which is electrically conductive; a plurality of electrical circuits provided in the playing area of the court; means for detecting which of said circuits the ball has bounced on; a computer for accessing and processing information accessible to it from the electrical circuits and other electrical detecting means and programmed in accordance with the rules of tennis currently in force; visual and/or audible display means for indicating the latest state of play, controlled by the output of the computer; and manually operated means for updating said display means.

31. A computer system according to claim 30, wherein each tennis ball cover is made of cloth into which electrically conductive material has been introduced.

32. A computer system according to claim 30, additionally including a playing surface having electrical circuits introduced into the playing suurface.

33. A computer system according to claim 30, wherein said display system incorporates electronic means for indicating the exact state of play in a doubles or singles tennis match.

* * * * *